United States Patent [19]

Kato et al.

[11] Patent Number: 5,041,348

[45] Date of Patent: Aug. 20, 1991

[54] ELECTROPHOTOGRAPHICC LITHOGRAPHIC PRINTING PLATE PRECURSOR

[75] Inventors: Eiichi Kato; Akio Oda; Seishi Kasai, all of Shizuoka, Japan

[73] Assignee: Fuji Photo Film Co., Ltd., Kanagawa, Japan

[21] Appl. No.: 592,388

[22] Filed: Oct. 3, 1990

[30] Foreign Application Priority Data

Oct. 6, 1989 [JP] Japan ..... 1-260161
Nov. 9, 1989 [JP] Japan ..... 1-290015

[51] Int. Cl.[5] ..... G03G 5/087

[52] U.S. Cl. ..... 430/49; 430/87; 430/96

[58] Field of Search ..... 430/49, 96, 7

[56] References Cited

U.S. PATENT DOCUMENTS 4,960,661 10/1990 Kato et al. .
4,971,871 11/1990 Kato et al. ..... 430/49

*Primary Examiner*—Marion E. McCamish
*Assistant Examiner*—Rosemary Ashton
*Attorney, Agent, or Firm*—Sughrue, Mion, Zinn Macpeak & Seas

[57] ABSTRACT

An electrophotographicc lithographic printing plate precursor, in which the effect by the hydrophilic property of non-image areas is further improved, and which is stable during storage even under very severe conditions and capable of readily realizing the hydrophilic property in a short time during processing of rendering hydrophilic is provided, which utilizes an electrophotograhic photoreceptor comprising a conductive support having provided thereon at least one photoconductive layer containing photoconductive zinc oxide and a binder resin, wherein said binder resin comprises at least one resin containing at least one polymeric component having at least one of functional groups represented by the following General Formula (I) and General Formula (II):

General Formula (I)

$$-W_1\text{-}(CH_2)_{n1}\text{-}CH{=}CH_2$$

General Formula (II)

$$-W_2\text{-}(CH_2)_{n2}\text{-}CH_2CH_2\text{-}X$$

wherein $-W_1-$ and $-W_2-$ each represent $-SO_2-$, $-CO-$ or $-OOC-$, $n_1$ and $n_2$ each represent 0 or 1 and X represents a halogen atom.

18 Claims, No Drawings

ELECTROPHOTOGRAPHICC LITHOGRAPHIC PRINTING PLATE PRECURSOR

BACKGROUND OF THE INVENTION

1. Field of the Invention

This invention relates to an electrophotographic lithographic printing plate precursor made by an electrophotographic system and more particularly, it is concerned with an improvement in a photoconductive layer forming binder resin for the lithographic printing plate precursor.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a resin binder is subjected to an ordinary electrophotographic processing to form a highly lipophilic toner image on the surface of the photoreceptor, followed by treating the surface with an oil-desensitizing solution referred to as an etching solution to selectively render non-image areas hydrophilic and thus obtain an offset printing plate.

Requirements of offset masters for obtaining satisfactory prints include: (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties sufficiently to be free from stains even upon printing a large number of prints.

It is known that these properties are affected by the ratio of zinc oxide to a resin binder in the photoconductive layer. For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

Resin binders which have been conventionally known include silicone resins (see Japanese Patent Publication No. 6670/1959), styrene-butadiene resins (see Japanese Patent Publication No. 1950/1960), alkyd resins, maleic acid resins, polyamides (see Japanese Patent Publication No. 11219/1960), vinyl acetate resins (see Japanese Patent Publication No. 2425/1966), vinyl acetate copolymer resins (see Japanese Patent Publication No. 2426/1966), acrylic resins (see Japanese Patent Publication No. 11216/1960), acrylic ester copolymer resins (see Japanese Patent Publication Nos. 11219/1960, 8510/1961, and 13946/1966), etc. However, electrophotographic light-sensitive material using these known resins suffer from one or more of several disadvantages, such as 1) low charging characteristics of the photoconductive layer, 2) poor quality of a reproduced image (particularly dot reproducibility or resolving power), 3) low sensitivity to exposure; 4) insufficient oil-desensitization attained by oil-desensitization for use as an offset master (which results in background) stains on prints when used for offset printing), 5) insufficient film strength of the light-sensitive layer (which causes release of the light-sensitive layer during offset printing and failure to obtain a large number of prints), 6) susceptibility of image quality to influences of environment at the time of electrophotographic image formation (such as high temperature and high humidity), and the like.

For particular use as an offset master, occurrence of background stains due to insufficient oil-desensitivity presents a serious problem. In order to solve this problem, various resins for binding zinc oxide have been proposed, including resins of $\overline{M}w$ $1.8-10\times10^{-4}$ and Tg 10°-80° C. obtained by copolymerizing (meth)acrylate monomers and other monomers in the presence of fumaric acid in combination with copolymers of (meth)acrylate monomer and other monomers than fumaric acid, as disclosed in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl (meth)acrylate unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 68046/1983; and the like. These resins function to improve the oil-desensitivity of photoconductive layers.

Nevertheless, evaluation of such resins as noted above for improving the oil-desensitization indicates that none of them is completely satisfactory in terms of stain resistance, printing durability and the like.

Furthermore, it has hitherto been studied to use resins having functional groups capable of forming hydrophilic groups through decomposition such as a binder resin, for example, those having functional groups capable of forming hydroxyl groups through decomposition as disclosed in Japanese Patent Laid-Open Publication Nos. 195684/1987 and 210475/1987 and Japanese Patent Application No. 8446/1988 and those having functional groups capable of forming carboxyl groups through decomposition as disclosed in Japanese Patent Laid-Open Publication Nos. 212669/1987, 63977/1989 and Japanese Patent Application No. 14576/1988.

These resins are those which form hydrophilic groups through hydrolysis or hydrogenolysis with an oil-desensitizing solution or dampening water used during printing. When using them as a binder resin for a lithographic printing plate precursor, it is possible to avoid various problems, e.g., deterioration of smoothness, deterioration of electrophotographic properties such as dark charge retention and photosensitivity, etc., which are considered to be caused by strong interaction of the hydrophilic groups and surfaces of photoconductive zinc oxide particles in the case of using resins intrinsically having hydrophilic groups per se, and at the same time, a number of prints with clear image quality and without background stains can be obtained, since the hydrophilic property of non-image areas rendered hydrophilic with an oil-desensitizing solution is further increased by the above described hydrophilic groups formed through decomposition in the resin to make clear the lipophilic property of image areas and the hydrophilic property of non-image areas and to prevent the non-image areas from adhesion of a printing ink during printing.

In the resin of such a type as to form a hydrophilic group by the above described decomposition reaction, the carboxyl group or hydroxyl group previously masked with a protective group is subjected to decomposition reaction with a processing solution to release the protective group. For the binder resin of this type, therefore, it is required, as important properties, that during storage, the resin is stably present without being hydrolyzed due to the humidity (moisture) in the air and during processing for rendering hydrophilic, the protective group removing reaction rapidly proceeds to form a hydrophilic group and the hydrophilic property of non-image areas can be improved.

However, it is found that provision of a hydrophilic group-forming functional group (protective group) which is stably present without decomposition even under severer conditions, e.g., during storage at a high temperature and high humidity for a long time, results in difficulty in a rapid decomposition with a processing solution and rapid feasibility of hydrophilic property.

SUMMARY OF THE INVENTION

It is an object of the present invention to provide an electrophotographic lithographic printing plate precursor, whereby the disadvantages of the prior art, as described above, can be overcome.

It is another object of the present invention to provide a lithographic printing plate precursor in which a binder resin for forming a photoconductive layer is improved.

It is a further object of the present invention to provide an electrophotographic lithographic printing plate precursor, in which the effect by the hydrophilic property of non-image areas is further improved, and which is stable during storage even under very severe conditions and capable of readily realizing the hydrophilic property in a short time during processing for rendering hydrophilic.

These objects can be attained by an electrophotographic lithographic printing plate precursor utilizing an electrophotographic photoreceptor comprising a conductive support having provided thereon at least one photoconductive layer containing photoconductive zinc oxide and a binder resin, wherein said binder resin comprises at least one resin containing at least one polymeric component or recurring unit having a functional group represented by the following General Formula (I) and/or General Formula (II):

General Formula (I)

$$-W_1\text{-}(CH_2)_{n_1}\text{-}CH{=}CH_2$$

General Formula (II)

-continued $$-W_2\text{-}(CH_2)_{n_2}\text{-}CH_2CH_2\text{-}X$$

wherein $-W_1-$ and $-W_2-$ each represent $-SO_2-$, $-CO-$ or $-OOC-$, $n_1$ and $n_2$ each represent 0 or 1 and X represents a halogen atom.

In the above described General Formulae (I) and (II), $n_1$ and $n_2$ are preferably 0 and the halogen atom as X includes fluorine, chlorine, bromine and iodine atoms.

DETAILED DESCRIPTION OF THE INVENTION

In the present invention, the resin containing at least one polymeric component having a functional group represented by the above described General Formula (I) and/or General Formula (II) can previously be crosslinked and in this case, the resin has water proof property, which is preferable when realizing the hydrophilic property through reaction with a processing solution for rendering hydrophilic.

The resin containing at least one polymeric component having a functional group represented by the above described General Formula (I) or General Formula (II) may be a resin further containing at least one functional group causing a hardening reaction by heat and/or light.

In a preferable embodiment of the present invention, in addition to the resin containing at least one polymeric component having a functional group represented by General Formula (I) and/or (II), which will hereinafter be referred to as Resin A sometimes, at least one heat and/or light hardenable resin as Resin B is incorporated optionally with a crosslinking agent.

The feature of the electrophotographic lithographic printing plate precursor according to the present invention consists in that at least a part of the binder resin in the photoconductive layer comprises Resin A containing at least one functional group represented by General Formula (I) or (II) and optionally Resin B consisting of a heat and/or light hardenable resin, preferably with a crosslinking agent, whereby when processing with a processing solution containing at least one hydrophilic compound with nucleophilic reactivity, the hydrophilic compound with nucleophilic reactivity is additionally reacted with the end of the functional group represented by General Formula (I) or (II) of Resin A and the binder resin can thus reveal hydrophilic property while simultaneously, it is rendered not or hardly soluble in water with maintaining the hydrophilic property because of the crosslinked structure in the resin.

Thus, the lithographic printing plate precursor of the present invention has various advantages that an image faithful to an original can be reproduced without occurrence of background stains owing to the high hydrophilic property of non-image areas, the smoothness and electrostatic characteristics of the photoconductive layer are excellent and furthermore, the durability is improved.

In addition, the lithographic printing plate precursor of the present invention is not sensitive to environmental influences during plate making, is very excellent in storage property before processing and is capable of undergoing rapidly a processing for rendering hydrophilic.

Such a mechanism that the binder resin of the present invention is rendered hydrophilic by a hydrophilic compound with nucleophilic reactivity will be illustrated by the following reaction formula (1) in which p represents a resin part having a functional group represented by General Formula (I) or (II), for example, as to a case of using sulfite ion as the hydrophilic compound of nucleophilic reactivity:

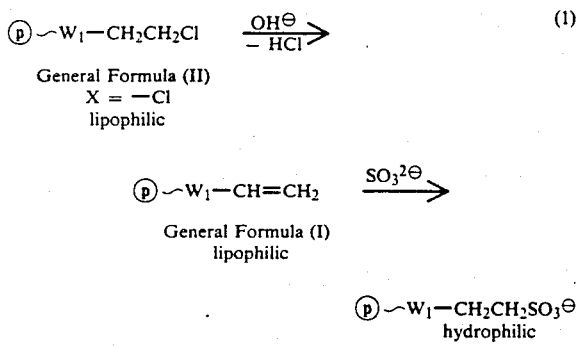

That is to say, Resin A of the present invention has the feature that only when non-image areas as a lithographic printing plate precursor is subjected to oil-desensitization, it is reacted with a nucleophilic compound in a processing solution as described above, whereby the hydrophilic group is added to the end thereof and it is rendered hydrophilic. Since Resin A is not reactive with moisture in the air, there is no problem to be feared in storage of the lithographic printing plate precursor of the present invention. Since vinylsulfone group, vinylcarbonyl group or acryloxy group, represented by General Formula (I), is a functional group which is very rapidly reactive with a nucleophilic compound, it is possible to rapidly render hydrophilic.

The functional group represented by General Formula (II) can be converted into the corresponding functional group represented by General Formula (I) by an alkali treatment to readily remove the hydrogen halide as shown in Reaction Formula (1) and can thus be used in the similar manner to General Formula (I).

Resin A used in the present invention will now be illustrated in detail. The functional group of the polymeric component or recurring unit contained in Resin A is represented by General Formula (I) or (II):

General Formula (I)

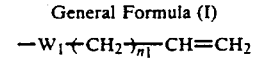

General Formula (II)

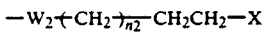

In general Formulae (I) and (II), —$W_1$— and —$W_2$— each represent —$SO_2$—, —CO— or —OOC—, $n_1$ and $n_2$ each represent 0 or 1 and X represents a halogen atom. In the General Formulae (I) and (II), $n_1$ and $n_2$ are preferably 0 and the halogen atom as X includes fluorine, chlorine, bromine and iodine atoms.

Specific, but not limiting, examples of the copolymer constituent containing the functional group represented by General Formula (I) and/or General Formula (II) of Resin A include those represented by the following repeating unit of General Formula (III):

General Formula (III)

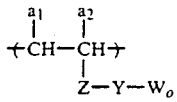

wherein Z represents —COO—, —OCO, —O—, —CO—,

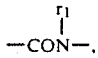

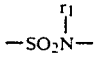

wherein $r_1$ represents hydrogen atom or a hydrocarbon group, —CONHCOO—, —CONHCONH—, —$CH_2$COO—, —$CH_2$OCO— or

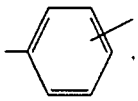

Y represents a direct bond or organic radical for connecting —Z— and —$W_0$, (—Z-Y) can directly connect

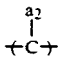

and —$W_0$, $W_0$ represents the functional group represented by General Formula (I) or (II) and $a_1$ and $a_2$ may be same or different, each being hydrogen atom, a halogen atom, cyano group, an alkyl group or an aryl group.

General Formula (III) will now be illustrated in detail. In this formula, Z represents preferably

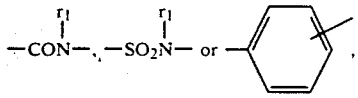

wherein $r_1$ represents hydrogen atom, an optionally substituted alkyl group of 1 to 8 carbon atoms, such as methyl, ethyl, propyl, butyl, pentyl, hexyl, octyl, 2-chloroethyl, 2-bromoethyl, 2-cyanoethyl, 2-methoxyethyl, 2-hydroxyethyl, 4-bromopropyl groups etc., an optionally substituted aralkyl group of 7 to 9 carbon atoms, such as benzyl, phenethyl, 3-phenylpropyl, chlorobenzyl, bromobenzyl, methylbenzyl, methoxybenzyl, chloromethylbenzyl, dibromobenzyl groups, etc., an optionally substituted aryl group such as phenyl, tolyl, xylyl, mesityl, methoxyphenyl, chlorophenyl, bromophenyl, chloromethylphenyl groups, etc.

Y represents a direct bond or an organic radical for connecting —Z— and —$W_0$. When Y represents the organic radical, this radical is a carbon-carbon bond, between which hetero atoms (including oxygen, sulfur and nitrogen atom) may be present, which specific examples include

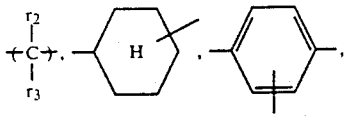

$\text{-}(\text{CH}{=}\text{CH})_n\text{-O})_n\text{-S})_n$

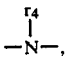

—COO—, —CONH—, $-SO_2-$, $-SO_2NH-$, —NHCOO—, —NHCONH— and

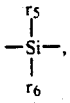

individually or in combination of these groups, wherein $r_2$, $r_3$, $r_4$, $r_5$ and $r_6$ have the meaning as the foregoing $r_1$.

$a_1$ and $a_2$ may be the same or different, each being a hydrogen atom, a halogen atom (e.g., chlorine, bromine), a cyano group, a hydrocarbon residue (an optically substituted alkyl group containing 1 to 12 carbon atoms, such as methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl, etc., an aralkyl group such as benzyl, phenetyl, etc., and an aryl group such as phenyl, tolyl, xylyl, chlorophenyl, etc.

In addition, the linkage moiety -(X-Y) in General Formula (III) may directly connect the moiety

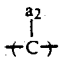

to the moiety $-W_0$.

Specific, but not limiting examples of the polymeric constituent containing the functional group represented by General Formula (I) or (II) will be illustrated below. In Examples (a-1) to (a-25), b represents —H or $-CH_3$, R represents $-CH{=}CH_2$, $-CH_2CH{=}CH$ or $-CH_2CH_2X$ and X represents —F, —Cl, —Br or —I.

(a-1)

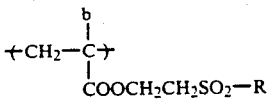

(a-2)

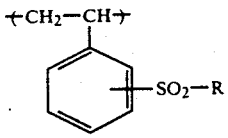

(a-3)

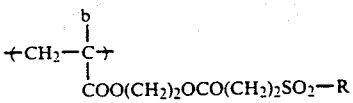

(a-4)

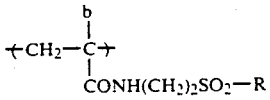

-continued (a-5)

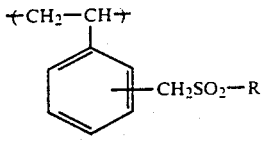

(a-6)

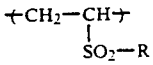

(a-7)

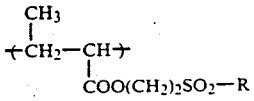

(a-8)

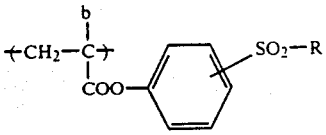

(a-9)

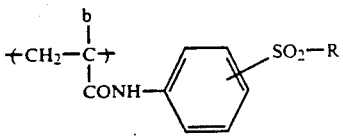

(a-10)

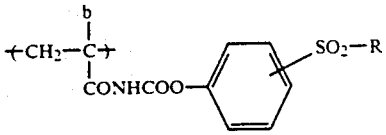

(a-11)

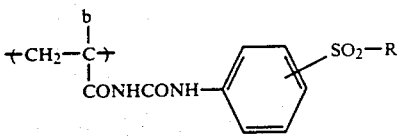

(a-12)

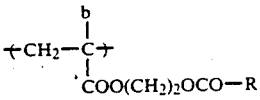

(a-13)

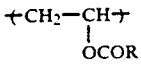

(a-14)

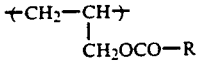

(a-15)

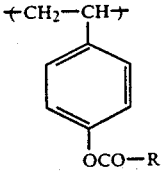

(a-16)

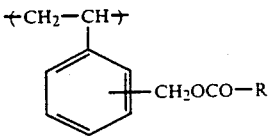

-continued (a-17)

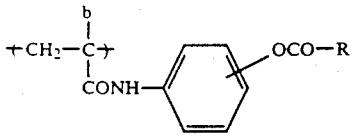

(a-18)

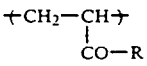

(a-19)

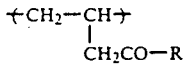

(a-20)

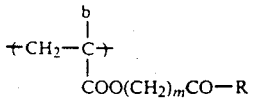

(m: integer of 1 ~ 4)

(a-21)

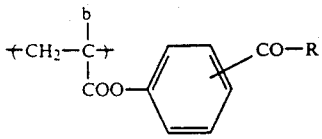

(a-22)

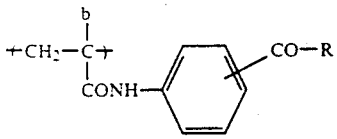

(a-23)

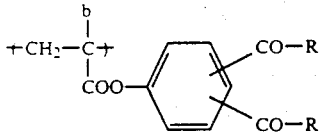

(a-24)

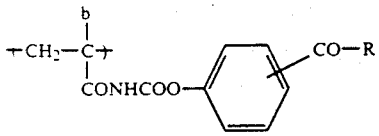

(a-25)

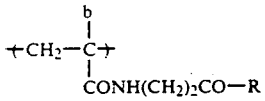

Resin A containing the polymeric component containing the functional group represented by General Formula (I) or (II) as described above can be synthesized by any of known methods, for example, by a method comprising subjecting to polymerization reaction a monomer containing the functional group represented by General Formula (I) or (II) and a polymerizable double bond group in the molecule (e.g. monomer corresponding to the recurring unit of General Formula (III)) and a method comprising reacting a low molecular compound containing the functional group represented by General Formula (I) or (II) with a high molecular compound containing a polymeric constituent containing a functional group reactive with the low molecular compound, which is called "polymer reaction".

Moreover, Resin A containing the functional group represented by General Formula (I) can be synthesized by synthesizing Resin A containing the functional group represented by General Formula (II) and then subjecting to an alkali treatment to remove the corresponding hydrogen halide.

In the above described monomer synthesis or polymer reaction, sulfonylation, carbonylation or carboxylic acid esterification can be carried out by methods, for example, described in Nippon Kagakukai, Shin-Jikken Kagaku Koza, Vol. 14, "Yuki Kagobutsu no Gosei to Hanno (Synthesis and Reaction of Organic Compounds)" page 751, 1000 and 1759 (1978), published by Maruzen KK and S. Patai, Z. Rappoport and C. Stirling "The Chemistry of Sulfones and Sulphoxides" page 165 (1988), published by John Wiley & Sons.

In Resin A of the present invention, the polymeric component containing the functional group represented by General Formula (I) and/or General Formula (II) is generally in a proportion of 1 to 95% by weight, preferably 20 to 90% by weight based on the whole copolymer in a case where Resin A is of the copolymer. Preferably, this resin has a molecular weight of $10^3$ to $10^6$, particularly $3\times10^3$ to $5\times10^5$.

Resin A of the present invention may be crosslinked, at least in part, in an electrophotographic lithographic printing plate precursor. As such a resin, there can be used a previously crosslinked resin during coating a light-sensitive layer-forming material in the plate-making step or a resin containing crosslinking functional groups causing a hardenable reaction by heat and/or light, which can be crosslinked in a process for producing a lithographic printing plate precursor (e.g. during drying). These resins can be used in combination.

When using, as a binder resin, such a resin that at least a part of the polymer is previously crosslinked (resin having a crosslinked structure in the polymer), it is preferably a resin which is hardly soluble or insoluble in acidic or alkaline solutions when the above described functional group contained in the resin gives hydrophilic property through an oil-desensitization treatment. Specifically, the solubility of the resin in distilled water at 20° to 25° C. is preferably at most 90% by weight, more preferably at most 70% by weight.

Introduction of a crosslinked structure in a polymer can be carried out by known methods, that is, a method comprising subjecting a monomer containing the group of General Formula (I) and/or (II) to polymerization reaction in the presence of a multifunctional monomer and a method comprising incorporating functional groups for effecting a crosslinking reaction in the polymer, then subjecting the polymer to polymer reaction with a compound containing the group of General Formula (I) or (II) and effecting the crosslinking.

Specifically, Resin A of the present invention can be prepared by a method comprising polymerizing a monomer containing two or more polymerizable functional groups (multifunctional monomer) with a monomer containing at least one functional group of General Formula (I) or (II) of the present invention, or a method comprising polymerizing the multifunctional monomer with a monomer containing a polar group such as —OH, —Cl, —Br, —I, —$NH_2$, —COOH, —SH,

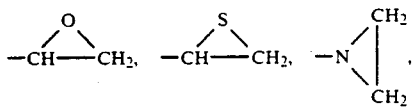

—N=C=O, —COCl, —$SO_2Cl$, etc., into which the functional group of General Formula (I) or (II) can be introduced, to prepare a copolymer and then introducing thereinto a low molecular compound containing the functional group of General Formula (I) or (II) by polymer reaction.

Examples of the polymerizable functional group are:

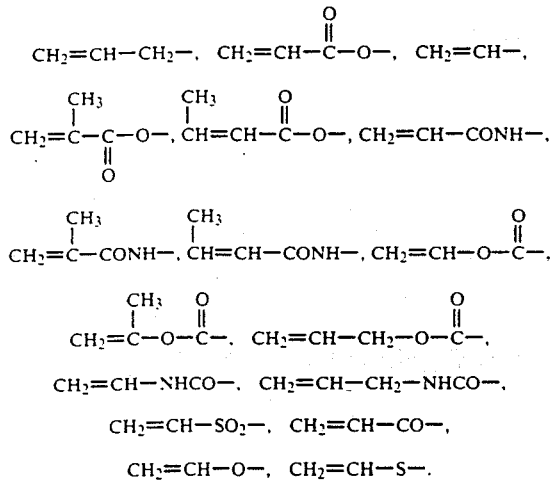

Any of monomers containing two or more same or different ones of these polymerizable functional groups can be used in the present invention.

Of these monomers, as the monomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glycol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the monomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allyl methacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer containing two or more polymerizable functional groups of the present invention is generally used in a proportion of at most 10 mole %, preferably at most 5 mole % to all monomers, which is polymerized to form a previously crosslinked resin.

In the case of a polymer containing the functional group represented by General Formula (I), however, it is preferable not to use $CH_2=CH—COO—$,

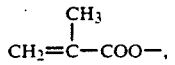

$CH_2=CH—CONH$, $CH_2=CH—SO_2$ and $CH_2=CH—CO—$ as the foregoing polymerizable functional group.

In the method comprising crosslinking a polymer containing functional groups for effecting a crosslinking reaction by polymer reaction, on the other hand, the functional group can be any group capable of causing a chemical reaction among the molecules to form chemical linkages. That is, the reaction mode of forming linkages among molecules by a condensation reaction or addition reaction, or crosslinkings by a polymerization reaction through heat and/or light can be utilized. Specifically, the functional groups include at least one combination selected from the group A consisting of functional groups containing dissociable hydrogen atoms (for example, —COOH, $—PO_3H_2$,

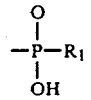

wherein $R_1$ represents an aliphatic group, preferably optionally substituted linear or branched alkyl group containing 1 to 12 carbon atoms, such as methyl, ethyl, propyl, chloromethyl, dichloromethyl, trichloromethyl, trifluoromethyl, butyl, hexyl, octyl, decyl, hydroxyethyl or 3-chloropropyl group, or $—OR_1'$ wherein $R_1'$ has the same meaning as $R_1$, —OH, —SH and $—NH.R_2$ wherein $R_2$ represents hydrogen atom or an alkyl group containing 1 to 4 carbon atoms, such as methyl, ethyl, propyl or butyl group) and the group B consisting of

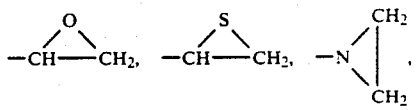

—NCO and —NCS and cyclic dicarboxylic acid anhydrides, or $—CONHCH_2OR_3$ wherein $R_3$ represents hydrogen atom or an alkyl group containing 1 to 6 carbon atoms, such as methyl, ethyl, propyl, butyl or hexyl group, or polymerizable double bond groups.

Examples of the polymerizable double bond group include those of the foregoing polymerizable functional group.

Furthermore, there can be used functional groups and compounds described in, for example, Takeshi Endo "Rendering Precise Heat Setting Polymers (Netsu-kokasei Kobunshi no Seimitsuka)" published by C.M.C. KK, 1986, Yuji Harazaki "Latest Binder Technique Handbook (Saishin Binder Gijutsu Binran)" Section II-1, published by Sogogijutsu Center, 1985, Takayuki Otsu "Synthesis and Design of Acrylic Resins and Development of New Uses (Akuriru Jushi no Gosei.Sekkei to Shin-yoto Kaihatsu)" published by Chubu Keiei Kaihatsu Center Shuppanbu, 1985, Eizo Omori "Functional Acrylic Resins (Kinosei Akuriru-kei Jushi)" published by Technosystem, 1985, Hideo Inui and Gentaro Nagamatsu "Light-sensitive Polymers (Kankosei Kobunshi)" published by Kodansha, 1977, Takahiro Tsunoda "New Light-sensitive Resins (Shin-Kankosei Jushi)", published by Insatsu Gakkai Shuppanbu, 1981, G. E. Green and B. P. Star "R.J. Macro. Sci. Reas. Macro. Chem.", C 21 (2), 187-273 (1981-82) and C. G. Roffey "Photopolymerization of Surface Coatings" published by A. Wiley Interscience Publ., 1982.

These crosslinking functional groups can be incorporated in one copolymeric constituent with the functional groups represented by General Formula (I) or (II), or can be incorporated in another copolymeric constituent than a copolymeric constituent containing the functional groups represented by General Formula (I) or (II).

Examples of the monomer corresponding to the copolymer constituent containing these crosslinking functional groups include vinyl compounds containing the functional groups copolymerizable with the polymeric constituents of General Formula (III).

These vinyl compounds include those described in, for example, Kobunshi Gakkai "Polymer Data Handbook -Kisohen-", published by Baihukan, 1986, for example, acrylic acid, αand/or β-substituted acrylic acid such as α-acetoxy, α-acetoxymethyl, α-(2-aminomethyl), α-chloro, α-bromo, α-fluoro, α-tributylsilyl, α-cyano, β-chloro, β-bromo, α-chloro-β-methoxy and α,β-dichloro substituted ones, methacrylic acid, itaconic acid, itaconic acid semi-esters, itaconic acid semiamides, crotonic acid, 2-alkenylcarboxylic acids such as 2-pentenoic acid, 2-methyl-2-hexenoic acid, 2-octenoic acid, 4-methyl-2-hexenoic acid and 4-ethyl-2-octenoic acid, maleic acid, maleic acid semi-esters, maleic acid semi-amides, vinylbenzenecarboxylic acid, vinylbenzenesulfonic acid, vinylsulfonic acid, vinylphosphonic acid, semi-ester derivatives of vinyl groups or allyl groups of dicarboxylic acids and este derivatives and amide derivatives of these carboxylic acids or sulfonic acids containing crosslinking functional groups in the substituents.

In Resin A of the present invention, the content of "the copolymeric components containing the crosslinking functional groups" is preferably 1 to 80% by weight, more preferably 5 to 50% by weight based on the whole quantity of the binder resin.

In a preferred embodiment of the present invention, Resin A of the present invention contains functional groups capable of undergoing a crosslinking reaction with Resin B by heating or irradiating. As these functional groups, there can be used those similar to the following crosslinking functional groups contained in Resin B (heat and/or light-hardenable functional groups: sometimes referred to as hardenable functional groups). In the case of Resin A containing the hardenable functional groups, "the content of copolymeric constituents containing the hardenable functional groups" is preferably 1 to 20% by weight, more preferably 3 to 10% by weight in Resin A.

In the present invention, incorporation of at least one functional group selected from the group consisting of the hardenable functional groups in Resin A is carried out by a method comprising introducing a low molecular, hardenable functional group-containing compound into a polymer containing functional groups represented by General Formula (I) or (II) by polymer reaction, or a method comprising copolymerizing at least one monomer corresponding to the copolymeric component containing at least one of the functional groups with a monomer corresponding to the repeating unit represented by General Formula (I) or (II) (monomer synthesis).

The former polymer reaction can be carried out by any of known methods, for example, Nippon Kagakukai Edition, Shin-Jikken Kagakukoza, Vol. 14, "Synthesis and Reaction of Organic Compounds (I) to (V) (Yuki Kagobutsu no Gosei to Hanno)" published by Maruzen KK, 1978, and Yoshio Iwakura and Keisuke Kurita "Reactive Polymers (Hannosei Kobunshi)" published by Kohdansha (1977).

As a monomer corresponding to the copolymeric component containing the hardenable functionable group, used in the latter monomer synthesis method, there can be used vinyl compounds containing the crosslinking functional groups, which are copolymerizable with the polymeric component containing the hydrophilic group-forming functional group in Resin A (e.g. compound corresponding to General Formula (III)), such as those exemplified above as the monomer corresponding to the copolymeric component containing the crosslinking functional groups.

Resin B used in the present invention will now be illustrated in detail. Resin B is a hardenable resin causing a crosslinking reaction by heat and/or light, preferably causing a crosslinking reaction with the functional group described above in Resin A, and includes any of resins containing "heat and/or light-hardenable functional groups (sometimes referred to as hardenable functional groups in brief)" which will hereinafter be illustrated. As illustrated above, these hardenable functional groups may be contained in Resin A.

As the light-hardenable functional group of the hardenable functional groups of the present invention, there can be used functional groups used in light-sensitive resins of the prior art as light-hardenable resins, for example, described in Hideo Inui and Gentaro Nagamatsu "Light-sensitive Polymers (Kankosei Kobunshi)" Kodansha KK, 1977, Takahiro Tsunoda "New Light-sensitive Resins (Shin-kankosei Jushi)" published by Insatsu Gakkai Shuppanbu, 1981, G. E. Green and B. P. Strark "J. Macro. Sci. Reas. Macro. Chem." C 21 (2), 1897-273 (1981-82) and C. G. Rattey "Photopolymerization of Surface Coatings" published by A. Wiley Interscience Pub., 1982).

As the heat-hardenable functional group of the hardenable functional groups of the present invention, there can be used functional groups, for example, cited in the literatures described above to exemplify the polymerizable double bond groups.

Specifically, there are functional groups (Group A) each having dissociable hydrogen and functional groups (Group B) capable of chemically reacting and bonding with Group A, or polymerizable double bond groups, which will hereinafter be exemplified.

As the functional group having dissociable hydrogen atom, for example, there are given —OH group, —SH group, $—NH_2$ group, $—NHR_1$ group wherein $R_1$ represents a hydrocarbon group, e.g., optionally substituted alkyl group containing 1 to 10 carbon atoms, such as methyl, ethyl, propyl, butyl, hexyl, octyl, decyl, 2-chloroethyl, 2-methoxyethyl, 2-cyanoethyl, etc., optionally substituted cycloalkyl group containing 4 to 8 carbon atoms, such as cycloheptyl, cyclohexyl, etc., optionally substituted aralkyl group containing 7 to 12 carbon atoms, such as benzyl, phenethyl, 3-phenylpropyl, chlorobenzyl, methylbenzyl, methoxybenzyl group, etc., and optionally substituted aryl group such as phenyl, tolyl, xylyl, chlorophenyl, bromophenyl, methoxyphenyl, naphthyl group, etc., —COOH group, $—PO_3H_2$ group and the like.

As the functional group (Group B) capable of bonding with the functional group having dissociable hydrogen, for example, there are given groups of

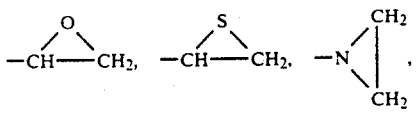

$—CONHCH_2OR_2$ wherein $R_2$ represents hydrogen atom or an alkyl group having 1 to 8 carbon atoms, such as methyl, ethyl, propyl, butyl, hexyl, octyl group, etc., —N=C=O and

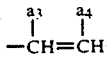

wherein $a_3$ and $a_4$ each represent hydrogen atoms, halogen atoms such as chlorine, bromine atom, etc., or alkyl groups containing 1 to 4 carbon atoms, such as methyl, ethyl group, etc.

A crosslinked structure can be formed by chemical bonding of the functional groups, Groups A and B, for example, selected so as to combine at least one member respectively selected from Groups A and B shown in the following Table 1:

TABLE 1

| Functional Groups (Group A) (functional groups having dissociable hydrogen atoms) | Functional Groups (Group B) (functional groups capable of chemically reacting and bonding with Group A) |
|---|---|
| —OH, —SH or —NHR' wherein R' is H or hydrocarbon, —COOH, $—PO_3H$ | 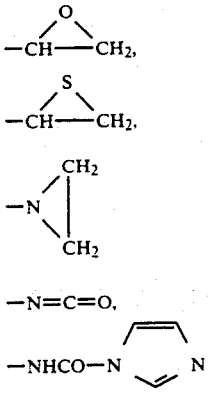 —N=C=O,  —N=C=S. cyclic dicarboxylic acid anhydrides |

The crosslinking reaction can be carried out by a polymerizable reaction using polymerizable double bond groups, exemplified above as the polymerizable functional groups.

As the monomer containing "the heat and/or light hardenable functional group" according to the present invention, there can be used any of monomers containing hardenable functional groups in the substituents, which are copolymerizable with the monomer corresponding to the foregoing "copolymeric component represented by General Formula (III)".

Examples of the copolymeric component containing the "heat and/or light-hardenable functional group" are the following repeating units (b-1) to (b-26):

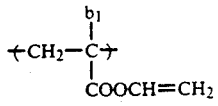

(b-1)

$b_1$: —H, $CH_3$ ($b_1$: same in the following)

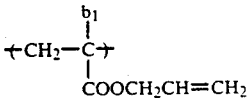

(b-2)

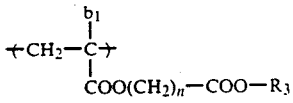

(b-3)

$R_3$: $—CH=CH_2$, $—CH_2CH=CH_2$ ($R_3$: same in the following)

n: integer of 1 ~ 11

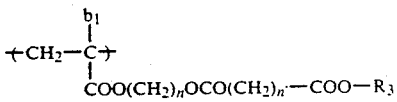

(b-4)

n, n': integer of 1 ~ 11

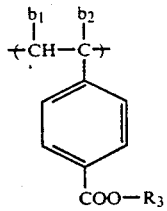

(b-5)

$b_2$: H, $CH_3$ ($b_2$: same in the following)

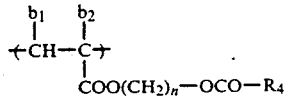

(b-6)

$R_4$: $—CH=CH_2$, $—C(CH_3)=CH_2$, $—CH=CH(CH_3)$ ($R_4$: same in the following)

n: integer of 1 ~ 11

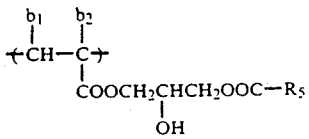

(b-7)

-continued
$R_5$: $-CH=CH_2$, $CH_2CH=CH_2$, $-C(CH_3)=CH_2$,
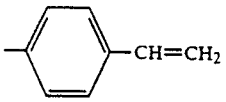
($R_5$: same in the following)
(b-8)
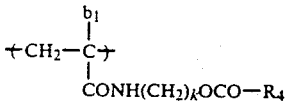
k: integer of 1 ~ 10
(b-9)
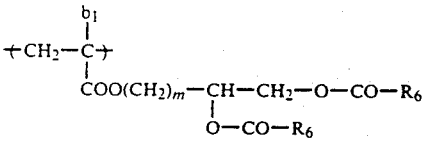
$R_6$: $-CH=CH_2$, $-C(CH_3)=CH_2$,
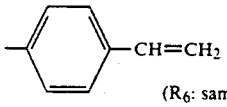
($R_6$: same in the following)
m: integer of 1 ~ 4
(b-10)
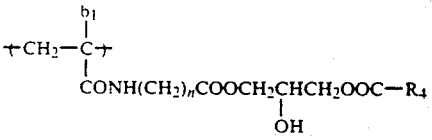
n: integer of 1 ~ 11
(b-11)
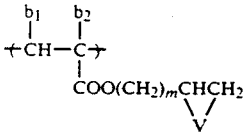
m: integer of 1 ~ 4
V: —S—, —O—
(b-12)
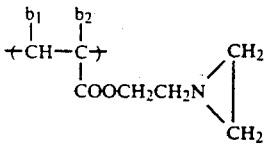
(b-13)
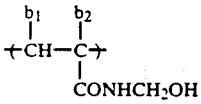
(b-14)
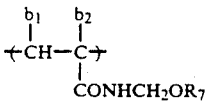
$R_7$: $C_1 \sim C_4$ alkyl group
-continued
(b-15)
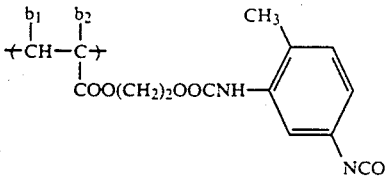
(b-16)
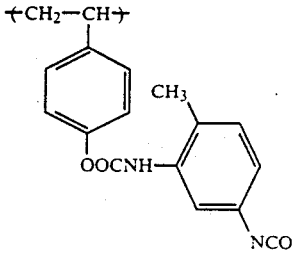
(b-17)
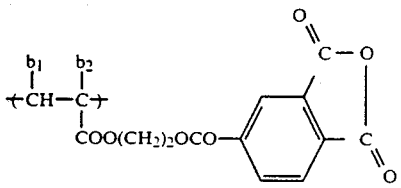
(b-18)
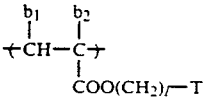
T: —OH, $-NH_2$
l: integer of 2 ~ 11
(b-19)
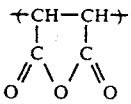
(b-20)
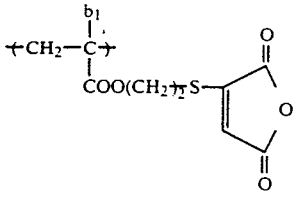
(b-21)
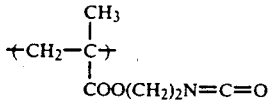
(b-22)
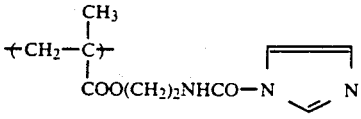
(b-23)
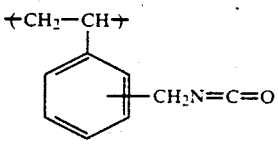

-continued

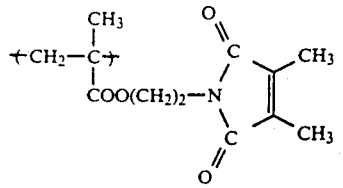

(b-24)

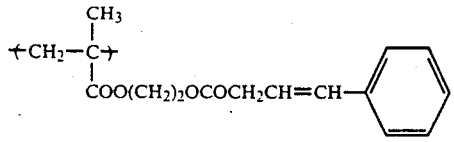

(b-25)

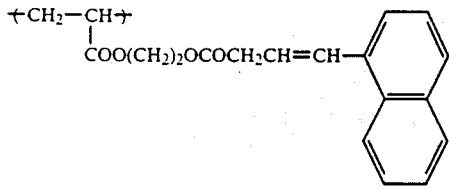

(b-26)

More specifically, there are given (meth)arcylic oopolymers containing at least 30% by weight, based on the total amount of the copolymer, of a monomer represented by the following General Formula (IV) as a copolymeric constituent, exemplified as Resin B.

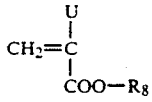

General Formula (IV)

wherein U is hydrogen atom, a halogen atom such as chlorine or bromine atom, cyano group, an alkyl group containing 1 to 4 carbon atoms, and $R_8$ is an alkyl group containing 1 to 18 carbon atoms, which can be substituted, such as methyl, ethyl, propyl, butyl, pentyl, hexyl, octyl, decyl, dodecyl, tridecyl, tetradecyl, 2-methoxyethyl or 2-ethoxyethyl group, an alkenyl group containing 2 to 18 carbon atoms, which can be substituted, such as vinyl, allyl, isopropenyl, butenyl, hexenyl, heptenyl or octenyl group, an aralkyl group containing 7 to 12 carbon atoms, which can be substituted, such as benzyl, phenethyl, methoxybenzyl, ethoxybenzyl or methylbenzyl group, a cycloalkyl group containing 5 to 8 carbon atoms, which can be substituted, such as cyclopentyl, cyclohexyl or cycloheptyl group, or an aryl group, which can be substituted, such as phenyl, tolyl, xylyl, mesityl, naphthyl, methoxyphenyl, ethoxyphenyl, chlorophenyl or dichlorophenyl group.

In Resin B, the content of "copolymeric components containing crosslinking (hardenable) functional groups" is preferably 0.5 to 40% by weight.

The weight average molecular weight of Resin B is preferably $1\times10^3$ to $1\times10^5$, more preferably $5\times10^3$ to $5\times10^4$.

The ratio of Resin A and Resin B, used in the present invention, depending on the kind, grain diameter and surface state of inorganic photoconductive materials used therewith, is generally 5–80 of the former to 95–20 of the latter (by weight), preferably 10–50 to 90–50.

The binder resin of the present invention may further contain a crosslinking agent in addition to Resin A, or Resin A + Resin B. To this resin can optionally be added a reaction promoter so as to promote the crosslinking reaction, for example, acids such as acetic acid, propionic acid, butyric acid, benzenesulfonic acid, p-toluenesulfonic acid, etc., peroxides, azobis compounds, crosslinking agents, sensitizers, photopolymerizable monomers and the like.

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Dat Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane triisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Hiroshi Kakiuchi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

The quantity of the crosslinking agent used in the present invention is generally 0.5 to 30% by weight, preferably 1 to 10% by weight based on the resin used in the surface layer. In the present invention, a reaction promoter can be added as occasion demands.

In a case where the crosslinking reaction is carried out by a reaction system for forming chemical bonds among functional groups, for example, organic acids such as acetic acid, propionic acid, butyric acid, benzenesulfonic acid and p-toluenesulfonic acid are used as the promoter, while in another case where the crosslinking reaction is carried out by a polymerizable reaction system, there are used polymerization initiators such as peroxides and azobis compounds, the latter being preferable, and multifunctional polymerizable group-containing monomers such as vinyl methacrylate, acryl methcrylate, ethylene glycol diacrylate, polyethylene glycol diacrylate, divinyl succinate, divinyl adipate, diallyl succinate, 2-methylvinyl methacrylate, divinylbenzene and the like.

In the case of containing functional groups with light-crosslinking reactivity, there can be used compounds described in the foregoing literatures cited relating to light-sensitive resins, for example, compounds containing allylester groups, cinnamoylester groups, dimethylmaleimide ring groups, etc.

The binder resin having a crosslinked structure in a photoconductive layer can be obtained, in a process for the production of the resin of the present invention, by employing the above described method for forming a crosslinked structure, or a method comprising using a resin containing crosslinking functional groups causing a hardening reaction by heat and/or light, as described above, with the functional groups represented by General Formula (I) or (II) and effecting the crosslinking during the step of forming the photoconductive layer or irradiating heat and/or light before the oil-desensitization processing. Ordinarily, it is preferable to effect the crosslinking by a heat-hardening treatment. This heat-hardening treatment can be carried out by rendering severe the drying conditions in the production of a photoreceptor according to the prior art, for example, at a temperature of 60° to 120° C. for 5 to 120 minutes. Joint use of the above described reaction promoter results in that this treatment can be carried out under milder conditions.

In the present invention, other resins can ointly be used in addition to Resins A and B of the present invention, for example, silicone resins, alkyd resins, polybutylal resins, polyolefin resins, ethylenevinyl acetate resins, styrene resins, styrene-butadiene resins, acrylate-burtadiene resins, vinyl alkanate resins, polyester resins, acrylic resins and the like. For example, these resins are described in Takaharu Kurita and Jiro Ishiwataru "High Molecular Materials (Kobunshi)" 17, 278 (1968) and Harumi Miyamoto and Hidehiko Takei "Imaging" No. 8, page 9 (1973).

The resin of the present invention and the known resin can be mixed in optional proportions, but it is preferable to adjust the mixing proportion so that the contetn of the hydrophilic group-forming functional group-containing resin be 1 to 90% by weight, preferably 5 to 70% by weight based on the whole resin, since if less than 1% by weight, the resulting lithographic printing plate precursor meets with a problem that the hydrophilic property obtained by the oil-desensitization treatment with an oil-desensitizing solution or dampening water to result in background stains during printing, while if more than 90% by weight, the image-forming property during reproducing is not good and the film strength of the photoconductive layer during printing is lowered, resulting in deterioration of the durability.

The binder resin of the present invention is subjected to crosslinking after coating a light-sensitive layer forming composition. The crosslinking is preferably carried out, for example, by maintaining the drying conditions at a high temperature and/or for a long period of time, or by further subjecting to a heat treatment after drying the coating solvent, for example, at 60° to 120° C. for 5 to 120 minutes.

When using a light-crosslinking resin, the crosslinking is carried out by irradiating electron ray, X-rays, ultraviolet rays or plasma during, before or after drying and the reaction can further be promoted by the above described heating treatment during or after drying.

Resin A of the present invention has such an action that hydrophilic groups appear by an oil-desensitizing treatment to render non-image areas more hydrophilic.

Furthermore, in the precursor of the present invention, the binder resin having a crosslinked structure at least in a part of the polymer is capable of preventing the hydrophilic group-containing resin formed by an oil-desensitization processing from being water-soluble and dissolved out of the non-image area, while maintaining the hydrophilic property.

Thus, the hydrophilic property of a non-image area can further be enhanced by hydrophilic groups formed in the resin, such as sulfo, phosphono, carhoxyl and hydroxyl groups, and the durability is improved. Even if printing conditions become severer, for example, a printing machine is large-sized or printing pressure is fluctuated, a large number of prints with a clear image quality and free from background stains can be obtained.

In the lithographic printing precursor of the present invention, any type of photoconductive zinc oxides, well known in the art, can be used, for example, not only the so-called zinc oxide, but also acid-treated zinc oxides. The above described binder resin is generally used in a proportion of 10–100 parts by weight, preferably 10–60 parts by weight, more preferably 15–50 parts by weight, most preferably 15–40 parts by weight, based on 100 parts by weight of the photoconductive zinc oxide.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes, etc. and phthalocyanine dyes which can contain metals, as described in Harumi Miyamoto and Hidehiko Takei "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmethane dyes, xanthene dyes or phthalein dyes are described in Japanese Patent Publication No. 452/1976, Japanese Patent Laid-Open Publication Nos. 90334/1975, 114227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be used dyes described in F. M. Hammer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Patent Nos. 1,226,892, 1,309,274 and 1,405,898; and Japanese Patent Publication Nos. 7814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117–118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds, hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives are not particularly limited, but are generally 0.0001 to 2.0% by weight based on 100 parts by weight of the photoconductive zinc oxide.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

The photoconductive layer of the present invention can be provided on a support as well known in the art. Generally, a support for an electrophotographic light-sensitive layer is preferably electroconductive and as the electroconductive support, there can be used, as known in the art, substrates such as metals, papers, plastic sheets, etc. which are rendered electroconductive by impregnating low resistance materials therein, substrates whose back surface, opposite to the surface to be provided with a light-sensitive layer, is made electroconductive, which is further coated with at least one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or rendered electroconductive are described in Yukio Sakamoto "Electrophotography (Denshi Shashin)" 14 (No. 1), pages 2 to 11 (1975), Hiroyuki Moriga "Introduction to Chemistry of Special Papers (Nyumon Tokushushi no Kagaku)" Kobunshi Kankokai (1975), M. F. Hoover "J. Macromol. Sci. Chem." A-4 (6), pp. 1327–1417 (1970), etc.

Production of a lithographic printing plate using the electrophotographic lithographic printing plate precursor of the present invention can be carried out in known manner by forming a copying image thereon and then subjecting the non-image area to an oil-desensitization processing according to the present invention, in which both of an oil-desensitization reaction of zinc oxide (hereinafter referred to as Reaction A) and oil-desensitization reaction of the resin (hereinafter referred to as Reaction B) proceed. The oil-desensitization processing can be carried out by any of (a) a method comprising effecting the Reaction A processing and thereafter the Reaction B processing, (b) a method comprising effecting the Reaction B processing and thereafter the Reaction A processing and (c) a method comprising effecting simultaneously the Reactions A and B processings.

In the method for the oil-desensitization of zinc oxide, there can be used any of known processing solutions, for example, containing, as a predominant component, ferrocyanide compounds as described in Japanese Patent Publication Nos. 7334/1965, 33683/1970, 21244/1971, 9045/1969, 32681/1972 and 9315/1980, and Japanese Patent Laid-Open Publication Nos. 239158/1987, 292492/1987, 99993/1988, 99994/1988, 107889/1982 and 101102/1977, phytic acid compounds as described in Japanese Patent Publication Nos. 28408/1968 and 24609/1970, and Japanese Patent Laid-Open Publication Nos. 103501/1976, 10003/1979, 83805/1978, 83806/1978, 127002/1978, 44901/1979, 2189/1981, 2796/1982, 20394/1982 and 20729/1984, metal chelate-forming water-soluble polymers as described in Japanese Patent Publication Nos. 9665/1963, 22263/1964, 763/1965, 28404/1968 and 29642/1972, and Japanese Patent Laid-Open Publication Nos. 126302/1977, 134501/1977, 49506/1978, 59502/1978 and 104302/1978, metal complex compounds as described in Japanese Patent Publication Nos. 15313/1980 and 41924/1979 and Japanese Patent Laid-Open Publication No. 104301/1978, and inorganic acid- and organic acid compounds as described in Japanese Patent Publication Nos. 13702/1964, 10308/1965 and 26124/1971 and Japanese Patent Laid-Open Publication Nos. 118501/1976 and 111695/1981.

On the other hand, the oil-desensitization (i.e. giving hydrophilic property) of the resin of the present invention, containing the functional groups represented by General Formula (I), can be accomplished by processing with a solution containing a compound having hydrophilic groups capable of readily undergoing nucleophilic reaction with the double bonds in water or a water-soluble organic solvent.

The hydrophilic compound causing a nucleophilic substitution reaction with the double bond of the functional group represented by General Formula (I) includes a hydrophilic compound containing a substituent having a nucleophilic constant n of at least 5.5 (Cf. R. G. Pearson, H. Sobel and J. Songstad "J. Amer. Chem. Soc." 90, 319 (1968)) and being dissolved in distilled water in a proportion of at least 1 part by weight to 100 parts by weight of distilled water, illustrative of which are hydrazines, hydroxylamine, sulfites such as ammonium, sodium, potassium and zinc sulfites, thiosulfates, mercapto compounds each containing at least one polar group selected from the group consisting of hydroxyl, carboxyl, sulfo, phosphono and amino groups in the molecules, hydrazide compounds, sulfinic acid compounds, primary amine compounds and secondary amine compounds.

Examples of the mercapto compound are 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenedicarboxylic acid, 2-mercaptoethanesulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, 2-methyl-2-mercapto-1-aminoacetic acid and the like.

Examples of the sulfinic acid are 2-hydroxyethylsulfinic acid, 3-hydroxypropanesulfinic acid, 4-hydroxybutanesulfinic acid, carboxybenzenesulfinic acid, dicarboxybenzenesulfinic acid and the like.

Examples of the hydrazide compound are 2-hydrazinoethanesulfonic acid, 4-hydrazinobutanesulfonic acid, hydrazinobenzenesulfonic acid, hydrazinobenzenedisulfonic acid, hydrazinobenzoic acid, hydrazinobenzenedicarboxylic acid and the like.

Examples of the primary or secondary amine compound are N-(2-hydroxyethyl)amine, N,N-di(2-hydroxyethyl)amine, N,N-di(2-hydroxyethyl)ethylenediamine, tri(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, 3-carboxypiperidine and the like.

The nucleophilic compounds are used in such a manner that each of them is contained in the foregoing oil-desensitization processing solution of zinc oxide (the foregoing method (c)) or in the foregoing processing solution of the binder resin (the foregoing method (a) or (b)).

The quantity of the nucleophilic compound in such a processing solution is generally 0.1 to 10 mol/l, preferably 0.5 to 5 mol/l. The processing solution has preferably a pH of at least 4. The processing conditions are a temperature of 15° to 60° C. and a period of time of 10 seconds to 5 minutes.

In addition to the above described nucleophilic compound and pH regulating agent, the processing solution may contain other compounds, for example, water-soluble organic solvents, individually or in combination, in a proportion of 1 to 50 parts by weight to 100 parts by weight of water, examples of which are alcohols such as methanol, ethanol, propanol, propargyl alcohol, benzyl alcohol, phenethyl alcohol, etc., ketones such as acetone, methyl ethyl ketone, acetophenone, etc., ethers such as dioxane, trioxane tetrahydrofuran, ethylene glycol, propylene glycol, ethylene glycol monomethyl ether, propylene glycol monomethyl ether, tetrahydropyran, etc., amides such as dimethylformamide, dimethylacetamide, etc., esters such as methyl acetate, ethyl acetate, ethyl formate, etc.

Furthermore, a surfactant can be incorporated in the processing solution in a proportion of 0.1 to 20 parts by weight to 100 parts by weight of water, illustrative of which are anionic, cationic and nonionic surfactants well known in the art, for example, described in Hiroshi Horiguchi "New Surfactants (Shin-Kaimen Kasseizai)" published by Sankyo Shuppan KK, 1975, Ryohei Oda and Kazuhir Teramura "Synthesize of Surfactants and Applications Thereof (Kaimen Kasseizai no Gosei to sono Oyo)" published by Maki Shoten, 1980.

The scope of the present invention should not be construed to be limited to the above described and specified compounds.

The oil-desensitization of the resin of the present invention, containing the functional group represented by General Formula (II), is characterized in that it is rendered hydrophilic by carrying out the hydrogen halide removing reaction as shown in the foregoing Reaction Formula (1) and then subjecting the resulting double bond to nucleophilic reaction with a nucleophilic reagent.

Since the hydrogen halide removing reaction readily proceeds in a processing solution with a pH of at least 6, removing the hydrogen halide and rendering hydrophilic though the nucleophilic reaction are accomplished by adjusting the pH of the oil-desensitization processing solution containing at least the above described nucleophilic compound to 6 or more.

More preferably, the processing solution has a pH of at least 8. In addition, after the hydrogen halide removing reaction is allowed to proceed in a solution with a pH of at least 6, the oil-desensitization can be carried out with the processing solution containing the nucleophilic compound.

The present invention will now be illustrated in greater detail by way of example, but it should be understood that the present invention is not limited thereto.

EXAMPLES

Synthetic Example 1 of Resin A: Resin A-1

A mixed solution of 63.5 g of benzyl methacrylate, 35 g of a monomer (M-1) having the following structure, 1.5 g of acrylic acid and 200 g of toluene was heated at a temperature of 75° C. under a nitrogen stream. While stirring, 1.0 g of azobis(isobutyronitrile) (hereinafter referred to as A.I.B.N.) was added thereto, followed by reacting for 4 hours, and 0.4 g of A.I.B.N. was further added, followed by reacting for 3 hours. The thus resulting polymer A-1 had a weight average molecular weight ($\overline{M}w$) of $4.3\times10^4$.

Monomer M-1

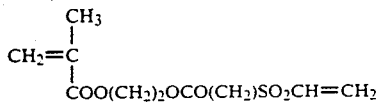

Resin A-1

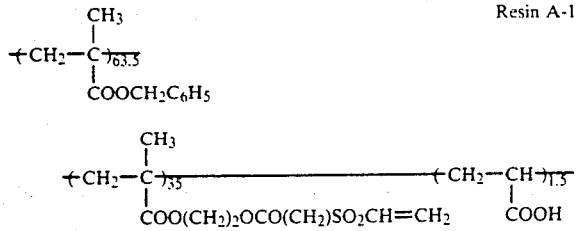

Synthetic Example 2 of Resin A: Resin A-2

A mixed solution of 52 g of phenyl methacrylate, 10 g of 2-hydroxyethyl methacrylate, 30 g of a monomer M-2 having the following structure, 2.0 g of acrylic acid and 200 g of toluene was heated at a temperature of 70° C. under a nitrogen stream. While stirring, 1.5 g of A.I.B.N. was added thereto, followed by reacting for 5 hours and 0.5 g of A.I.B.N. was further added, followed by reacting for 3 hours. The thus resulting polymer A-2 had a ($\overline{M}w$) of $3.5\times10^4$.

Monomer M-2

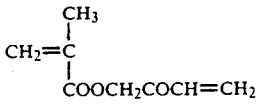

Resin A-2

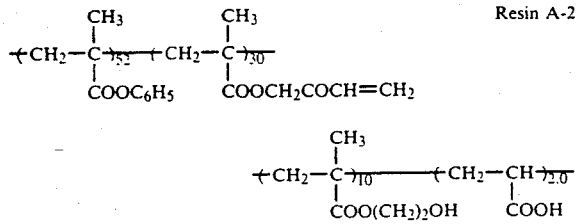

Synthetic Example 3 of Resing A: Resin A-3

A mixed solution of 64.5 g of 2-chlorophenyl methacrylate, 34 g of a monomer M-3 having the following structure, 1.5 g of methacrylic acid and 200 g of toluene was heated at a temperature of 75° C. under a nitrogen stream. While stirring, 1.0 g of A.I.B.N. was added thereto, followed by reacting for 4 hours and 0.4 g of A.I.B.N. was further added, followed by reacting for 3 hours. After cooling to room temperature, 15 g of triethylamine was added to the resulting reaction mixture and stirred at room temperature for 1 hour.

The precipitated triethylamine hydrochloride was separated by filtration and reprecipitated in 2000 ml of methanol. The precipitated white crystals was collected by filtering and dried under reduced pressure at room temperature, thus obtaining the polymer A-3 with a yield of 75 g and an (e,ovs/M/ w) of $4.5\times10^4$.

Monomer M-3

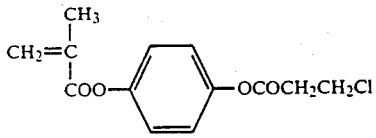

Resin A-3

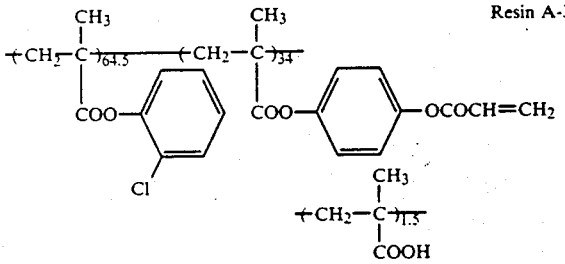

Synthetic Example 4 of Resin A: Resin A-4

A mixed solution of 18 g of ethyl methacrylate, 80 g of a monomer M-4 having the following structure, 2.0 g of divinylbenzene and 200 g of toluene was heated at a temperature of 70° C. under a nitrogen stream. While stirring, 1.5 g of azobis(isovaleronitrile) (hereinafter referred to as A.B.V.N.) was added thereto, followed by reacting for 4 hours and 0.5 g of A.B.V.N. was further added, followed by reacting for 3 hours. The thus resulting polymer A-4 had an (e,ovs/M/ w) of $1.5\times10^5$.

Monomer M-4

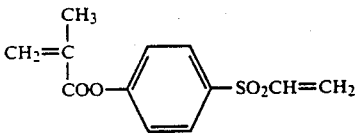

Resin A-4 (estimated partial structure)

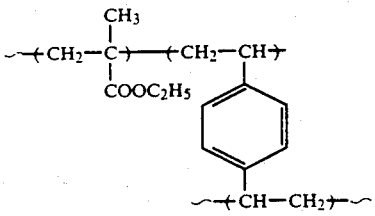

-continued

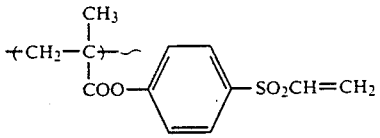

Synthetic Example 5 of Resin A: Resin A-5

A mixed solution of 85 g of the monomer M-4, 10 g of 2-hydroxyethyl methacrylate, 5 g of acrylic acid and 200 g of toluene was heated at a temperature of 90° C. under a nitrogen stream, to which 6 g of A.I.B.N. was added, followed by reacting for 4 hours. The thus resulting polymer A-5 had an ($\overline{M}$w) of $8.5\times10^3$.

Resin A-5

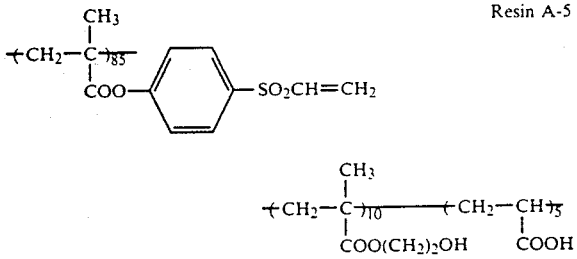

Synthetic Example 6 of Resin A: Resin A-6

A mixed solution of 78 g of a monomer M-5 having the following structure, 20 g of allyl methacrylate, 2 g of 2-(2-carboxyethylcarbonyloxy)ethyl methacrylate and 300 g of toluene was heated at a temperature of 60° C. under a nitrogen stream, to which 1.5 g of A.B.V.N. was added, followed by reacting for 4 hours and 0.5 g of A.B.V.N. was further added, followed by reacting for 3 hours. The thus resulting polymer A-6 had an (e,ovs/M/ w) of $6.8\times10^4$.

Monomer M-5

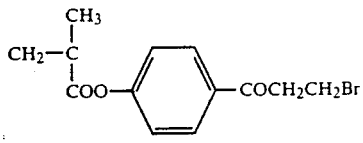

Resin A-6

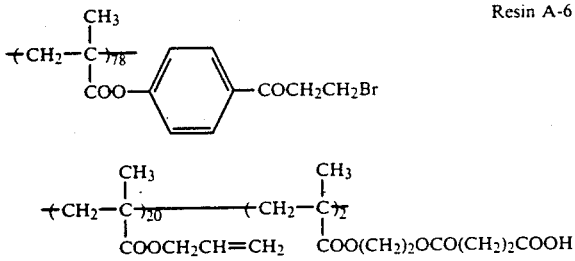

Synthetic Example 7 of Resin A: Resin A-7

A mixed solution of 95 g of the monomer M-5, 5 g of methacrylic acid, 3 g of divinylbenzene, 1.5 g of n-dodecyl mercaptan and 200 g of toluene was heated at 75° C. under a nitrogen stream. 1 g of A.I.B.N. was added thereto, followed by reacting for 4 hours, 0.5 g of A.I.B.N. was further added, followed by reacting for 3 hours and 0.5 g of A.I.B.N. was further added, followed by reacting for 3 hours. After cooling, 20 g of triethylamine was added and stirred at a temperature of 30° C.

for 1 hour. After the precipitated white crystals were separated by filtration, the crystals were reprecipitated in 1500 ml of methanol, collected by filtration and dried under reduced pressure at room temperature. The thus resulting polymer A-7 had an ($\overline{M}w$) of $7.3\times10^3$.

Resin A-7 (estimated partial structure)

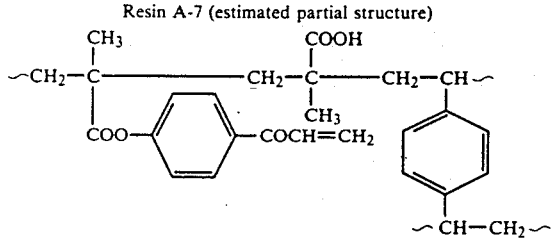

Synthetic Examples 8 to 14 of Resins A: Resins A-8 to A-14

Synthetic Example 6 of Resin A was repeated except changing the copolymeric components as shown in Table 2 to synthesize copolymers having the following structures as shown in Table 2. The resulting polymers A-8 to A-14 each had an ($\overline{M}w$) of $4\times10^4$ to $6\times10^4$.

TABLE 2

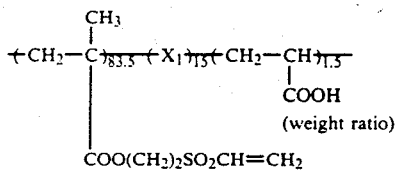

| Synthetic Examples | Resin A | Copolymeric Component: Chemical structure of $X_1$ |
|---|---|---|
| 8 | [A-8] | 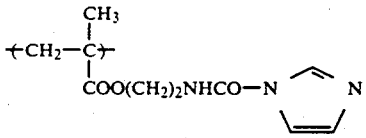 |
| 9 | [A-9] | 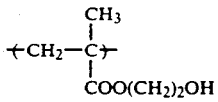 |
| 10 | [A-10] | 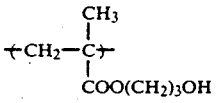 |
| 11 | [A-11] | 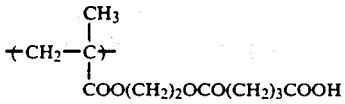 |
| 12 | [A-12] | 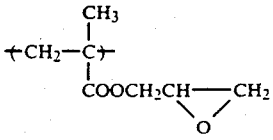 |

TABLE 2-continued

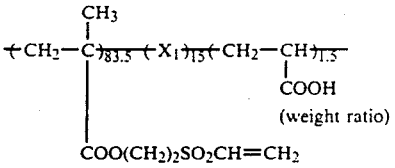

| Synthetic Examples | Resin A | Copolymeric Component: Chemical structure of $X_1$ |
|---|---|---|
| 13 | [A-13] | 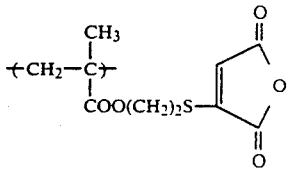 |
| 14 | [A-14] | 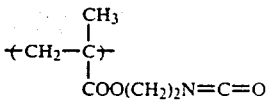 |

Example 1 and Comparative Example A

A mixture of 30 g (as solid) of Resin A-2, 10 g of a resin (R-1) consisting of a copolymer of benzyl methacrylate/methyl methacrylate/acrylic acid (79/20/1 by weight), having an ($\overline{M}w$) of $4.3\times10^{-4}$, 200 g of zinc oxide, 0.5 g of Rose Bengal, 0.02 g of uranine, 0.04 g of tetrabromphenol blue, 0.15 g of phthalic anhydride and 300 g of toluene was ball milled for 3 hours, to which 6 g of hexamethylene diisocyanate was then added, and the dispersion was further ball milled for 10 minutes to prepare a light-sensitive layer-forming composition. The thus resulting light-sensitive layer-forming composition was applied to a paper rendered electrically conductive to give a dry coverage of 25 g/m$^2$ by a wire bar coater, followed by drying at 100° C. for 60 minutes. The thus coated paper was allowed to stand in a dark place at a temperature of 20° C. and a relative humidity of 65% for 24 hours to prepare an electrophotographic light-sensitive material.

In the above described preparation example, the light-sensitive layer-forming composition was changed in the following copolymer to prepare a comparative light-sensitive material A.

Comparative Example A

The procedure of Example 1 was repeated except using only 40 g of Resin R-1 used in Example 1, as the binder resin of the photoconductive layer, to prepare an electrophotographic light-sensitive material for comparison.

These light-sensitive materials were then subjected to evaluation of the film property (surface smoothness), electrostatic characteristics, the oil-desensitization property of the photoconductive layer (represented by the contact angle with water of the photoconductive layer after the oil-desensitizing processing) and printing property. The printing property was evaluated by the use of a lithographic printing plate obtained by forming an image through exposing and developing using an automatic printing plate making machine ELP 404 V (—commercial name—, made by Fuji Photo Film Co., Ltd.) and ELP-T as a developing agent and subjecting to etching with an oil-desensitizing solution. As a printing machine, Hamada Star 800 SX (—commercial name, made by Hamada Star KK) was used.

The foregoing results are tabulated below:

TABLE 3

| | Example 1 | Comparative Example A |
|---|---|---|
| Smoothness of Photoconductive Layer[1] (sec/cc) | 120 | 110 |
| Electrostatic Characteristics[2] $V_0(-V)$ | 550 | 550 |
| $E_{1/10}$ (lux · sec) | 8.5 | 8.5 |
| Contact Angle With Water[3] | less than 10° | 10–25° large dispersion |
| Image Quality of Reproduced Image[4] | | |
| I: normal temperature and normal humidity | good | good |
| II: high temperature and high humidity | good | good |
| Background Staining[5] | | |
| I | good | more background stains |
| II | no stain even after 10000 prints | background staining from printing start |

The characteristic items described in Table 3 are evaluated as follows.

1) Smoothness of Photoconductive Layer

The resulting light-sensitive material was subjected to measurement of its smoothness (sec/cc) under an air volume of 1 cc using a Bekk smoothness tester (manufactured by Kumagaya Riko KK).

2) Electrostatic Characteristics

Each of the light-sensitive materials was subjected to corona discharge at −6 kV for 20 seconds in a dark room at a temperature of 20° C. and relative humidity of 65% using a paper analyzer (Paper Analyzer SP-428 —commercial name— manufactured by Kawaguchi Denki KK) and then allowed to stand for 10 seconds, at which the surface potential $V_0$ was measured. Then, the surface of the photoconductive layer was irradiated with a visible ray of illumination intensity 2.0 lux and the time required for decay of the surface potential $V_0$ to 1/10 was measured to evaluate an exposure quantity $E_{1/10}$ (lux.sec).

3) contact Angle with Water

Each of the light-sensitive materials was immersed for 30 seconds in a processing solution E-1 prepared by dissolving 53 g of sodium sulfite in 1000 ml of an oil-desensitizing processing solution ELP-E (—commercial name—, manufactured by Fuji Photo Film Co., Ltd., pH=4.5) and diluting by 10 times with distilled water, washed with water and then air-dried. On the thus oil-desensitized surface was placed a drop of 2 μl of distilled water.and the contact angle formed between the surface and water was measured by a goniometer.

4) Image Quality of Reproduced Image

Each of the light-sensitive materials and an automatic printing plate making machine ELP 404 V were allowed to stand for a whole day and night at normal temperature and normal humidity (20° C., 65%) and then subjected to plate making and forming a reproduced image, which was then visually observed to evaluate the fog and image quality I. The same procedure was repeated except that the plate making was carried out at a high temperature and high humidity (30° C., 80%) to evaluate the image quality II of a reproduced image.

5) Background Staining of Print

Each of the light-sensitive materials was subjected to printing plate making using an automatic printing plate making machine ELP 404 V to form a toner image and then to oil-desensitization under the same conditions as in the above described item 3). The resulting printing plate was mounted, as an offset master, on an offset printing machine (Hamada Star 800 SX —commercial name—, manufactured by Hamada Star KK) and subjected to printing of 500 sheets of fine quality paper to evaluate visually the background stains of all the prints, referred to as a background staining I.

The same procedure as described above was repeated except diluting by 2 times the oil-desensitizing processing solution used in the foregoing I, diluting by 2 times the dampening water during printing and increasing the printing pressure of the printing machine to evaluate a background staining II of prints. In the case of II, printing was carried out under severer conditions than in the case of I.

The reproduced images, obtained by the use of the light-sensitive materials of the present invention and Comparative Example A, were all clear.

Concerning the contact angle with water of each of the light-sensitive materials oil-desensitized with the oil-desensitizing solution, the material of the present invention showed a smaller value, i.e. less than 10°, which taught that it was sufficiently rendered hydrophilic.

When printing was carried out using these light-sensitive materials as an offset master for offset printing, the printing plate of the present invention exhibited better performance without occurrence of the background staining of the non-image area. When printing was further carried out under a higher printing pressure, the image quality of 10000 prints was maintained good without background stains in the present invention, while background stains occurred upon printing about 7000 prints in Comparative Example A.

It will clearly be understood that only the light-sensitive material of the present invention is capable of forming constantly clear reproduced images even if plate making is carried under fluctuated ambient conditions and giving 10000 or more prints free from background stains.

EXAMPLES 2 TO 8

Example 1 was repeated except using copolymers shown in Table 4 instead of Resin A-2 of the present invention, thus obtaining electrophotographic light-sensitive materials, each having an ($\overline{M}w$) in the range of $4\times10^4$ to $6\times10^4$.

TABLE 4

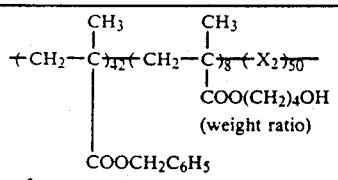

| Example | Resin of Present Invention | Copolymeric Component: Chemical structure of $X_2$ |
|---|---|---|
| 2 | [A-15] | 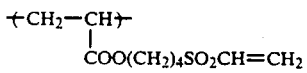 |
| 3 | [A-16] | 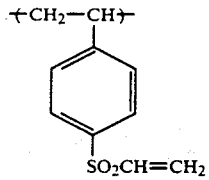 |
| 4 | [A-17] | 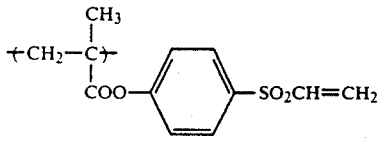 |
| 5 | [A-18] | 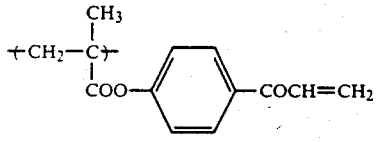 |
| 6 | [A-19] | 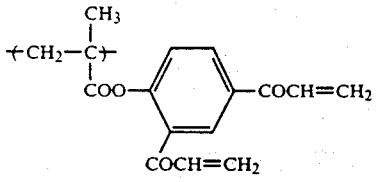 |
| 7 | [A-20] | 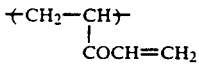 |
| 8 | [A-21] | 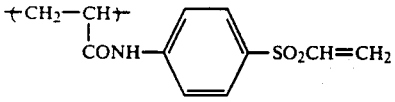 |

When each of the light-sensitive materials prepared in Example 2 to 8 was subjected to plate making using an automatic printing plate making machine ELP 404 V in an analogous manner to Example 1, the resulting master plate for offset printing had a density of at least 1.2 and clear image quality. When it was subjected to an etching treatment and printing, furthermore, 10000 or more prints with a clear image were obtained without occurrence of fog on non-image areas.

When the light-sensitive materials were further subjected to the same proceedings as described above, except after allowing to stand under conditions of 45° C. and 75% RH for 3 weeks, no change occurred in the results.

EXAMPLE 9

A mixture of 25 g (as solid content) of Resin A-6 of the present invention, 15 g of Resin R-1 used in Example 1, 200 g of zinc oxide, 0.02 g of uranine, 0.04 g of Rose Bengal, 0.03 g of tetrabromphenol blue, 0.20 g of maleic anhydride and 300 g of toluene was ball milled for 2 hours. Then, 4 g of allyl methacrylate and 0.4 g of A.I.B.N. were added to the resulting dispersion and further ball milled for 10 minutes to prepare a light-sensitive layer-forming composition. The thus resulting light-sensitive layer-forming composition was applied to a paper rendered electrically conductive to give a dry coverage of 22 g/m$^2$ by a wire bar coater, followed by heating at 105° C. for 2 hours. The thus coated paper was allowed to stand in a dark place at 20° C. and 65% RH for 24 hours to prepare an electrophotographic light-sensitive material.

When the resulting light-sensitive material was subjected to plate making by means of the same apparatus as that of Example 1, the resulting master plate had a density of at least 1.0 and clear image.

The plate was immersed in a processing solution consisting of an aqueous solution of 60 g of potassium sulfite, 80 g of methyl ethyl ketone and 15 g of Alkanol B (—commercial name—, manufactured by Du Pont Co.) per 1000 ml and having a pH of 9.5 at a temperature of 25° C. for 1 minute and then immersed and etched for 20 seconds in a solution obtained by diluting ELP-E (—commercial name—, manufactured by Fuji Photo Film Co., Ltd.) by 2 times with distilled water. The resulting plate was rendered sufficiently hydrophilic as represented by a contact angle with water of 10° or less.

When this plate was subjected to printing using the same printing machine as that of Example 1, 10000 or more prints of clear image were obtained without occurrence of fog on non-image areas. When the light-sensitive material was further subjected to the same processings as described above, except after allowing to stand under conditions of 45° C. and 75% RH for 3 weeks, no change appeared in the results.

EXAMPLES 10 TO 15

Example 9 was repeated except using copolymers A-22 to A-27 shown in Table 5 instead of Resin A-6 of the present invention, thus obtaining electrophotographic light-sensitive materials, each having an ($\overline{M}w$) in the range of $4\times10^4$ to $6\times10^4$.

TABLE 5

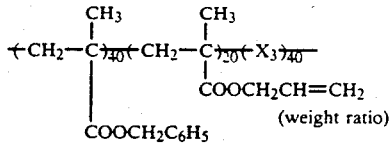

| Example | Resin of Present Invention | Copolymeric Component: Chemical structure of $X_3$ |
|---|---|---|
| 10 | [A-22] | 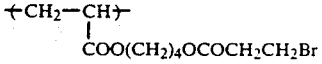 |
| 11 | [A-23] | 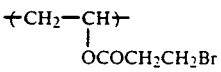 |
| 12 | [A-24] | 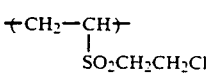 |

TABLE 5-continued

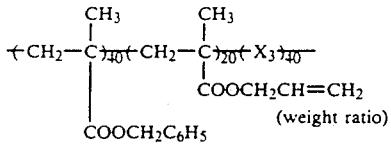

| Example | Resin of Present Invention | Copolymeric Component: Chemical structure of $X_3$ |
|---|---|---|
| 13 | [A-25] | 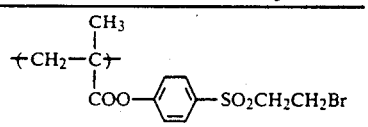 |
| 14 | [A-26] | 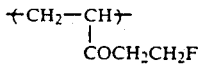 |
| 15 | [A-27] | 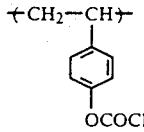 |

These light-sensitive materials were subjected to plate making, etching and printing in an analogous manner to Example 9. The resulting master plate for offset printing had a density of 1.0 or more and clear image quality, and after etching, showed a contact angle with water of less than 10°.

In printing, prints showed clear image quality without fog even after printing 10000 prints.

EXAMPLES 16 TO 20

Example 1 was repeated except using 20 g of Resin A-5 and 20 g of Resin R-1 instead of 30 g of Resin A-2 and 10 g of Resin R-1 and using compounds shown in Table 6 as a crosslinking agent instead of the hexamethylene diisocyanate, thus obtaining light-sensitive materials.

TABLE 6

| Example | Crosslinking Agent |
|---|---|
| 16 | ethylene glycol diglycidyl ether |
| 17 | Eponit 012 (-commercial name- made by Nitto Kasei KK) |
| 18 | Rika Resin PO-24 (-commercial name-, made by Shin Nippon Rika KK) |
| 19 | diphenylmethane diisocyanate |
| 20 | triphenylmethane triisocyanate |

These light-sensitive materials were subjected to plate making, etching and printing in an analogous manner to Example 1. The master plate, obtained after plate making, had a concentration of at least 1.0 and clear image quality. In printing, prints showed clear image quality without fog even after printing 10000 prints.

EXAMPLES 21 TO 32

Using each of the light-sensitive materials prepared in Examples 1 to 8 and 12 to 14, master plates for offset printing were prepared by carrying out the etching treatment as in the following.

0.5 mole of each of nucleophilic compounds shown in Table 7, 100 g of each of organic solvents shown in Table 7 and 10 g of Newcol B 4 SN (—commercial name—, manufactured by Nippon Nyukazai KK) were added to distilled water to 1000 ml, the pH being adjusted to 10.0 to prepare a processing solution. Each of the light-sensitive materials was immersed and etched in a solution prepared by diluting by 2 times ELP-E with distilled water for 20 seconds and then immersed in the above described processing solution at 25° C. for 1 minute.

The thus resulting plate was subjected to printing under the same printing conditions as in Example 1.

TABLE 7

| Example | Light-sensitive Material | Nucleophilic Compound | Organic Solvent |
|---|---|---|---|
| 21 | Example 1 | sodium sulfite | benzyl alcohol |
| 22 | " | monoethanolamine | " |
| 23 | Example 3 | diethanolamine | methyl ethyl ketone |
| 24 | Example 4 | thiomalic acid | ethylene glycol |
| 25 | Example 7 | thiosalicylic acid | benzyl alcohol |
| 26 | Example 5 | taurine | isopropyl alcohol |
| 27 | Example 6 | 4-sulfobenzene-sulfinic acid | benzyl alcohol |
| 28 | Example 7 | thioglycolic acid | ethanol |
| 29 | Example 8 | 2-mercaptoethyl-phosphonic acid | dioxane |
| 30 | Example 12 | 2-mercapto-1-aminoacetic acid | — |
| 31 | Example 13 | sodium thiosulfate | methyl ethyl ketone |
| 32 | Example 14 | ammonium sulfite | benzyl alcohol |

EXAMPLE 33

A mixture of 34 g (as solid content) of Resin A-5, 6 g of a resin (R-2) consisting of a copolymer of benzyl methacrylate/acrylic acid (95/5 by weight), having an ($\overline{M}w$) of $8.5\times10^3$, 200 g of zinc oxide, 0.018 g of a cyanine dye (I) having the following structure, 0.15 g of phthalic anhydride and 300 g of toluene was dispersed in a ball mill for 3 hours to prepare a light-sensitive layer-forming composition, which was then applied to a paper rendered electrically conductive to give a dry coverage of 200 g/m² by a wire bar coater, followed by drying at 110° C. for 30 seconds. The thus coated paper was allowed to stand in a dark place at 20° C. and 65% RH for 24 hours to prepare an electrophotographic light-sensitive material.

Cyanine Dye (I)

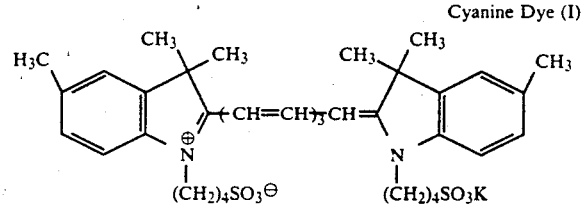

The light-sensitive material was then subjected to evaluation of the surface smoothness, electrostatic characteristics, image quality and printing property in an analogous manner to Example 1 to thus obtain the following results:

| | |
|---|---|
| Smoothness of Photoconductive Layer | 110 (sec/cc) |
| Electrostatic Characteristics[6)] | $V_{10}$: −555 (V)<br>D.R.R.: 86%<br>$E_{1/10}$: 48 (erg/cm²) |
| Image Quality[7)] | I (20° C., 65%): good ( )<br>II (30° C., 80%): good ( ) |
| Contact Angle with Water | 10° or less |

-continued

| | |
|---|---|
| Printing Durability | 8000 prints |

As described above, the light-sensitive material of the present invention exhibited excellent electrostatic characteristics and printing property. The electrostatic characteristics and image quality were measured by the following procedures:

6) Electrostatic Characteristics

The light-sensitive material was subjected to corona discharge at −6 kV for 20 seconds in a dark room at a temperature of 20° C. and relative humidity of 65% using a paper analyzer (Paper Analyzer SP-428 —commercial name— manufactured by Kawaguchi Denki KK) and then allowed to stand for 10 seconds, at which the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V by corona discharge, then irradiated with monochromatic light of a wavelength of 780 nm and the time required for dark decay of the surface potential ($V_{10}$) to 1/10 was measured to evaluate an exposure quantity $E_{1/10}$(erg/cm$^2$).

7) Image quality

The light-sensitive material was allowed to stand for a whole day and night under the following ambient conditions, charged at −5 kV, imagewise exposed rapidly at a pitch of 25 μm and a scanning speed of 300 m/sec under irradiation of 64 erg/cm$^2$ on the surface of the light-sensitive material using a gallium-aluminum-arsenic semiconductor laser (oscillation wavelength: 780 nm) with an output of 2.8 mW as a light source, developed with a liquid developer, ELP-T (—commercial name—, manufactured by Fuji Photo Film Co., Ltd.) and fixed to obtain a reproduced image which was then subjected to visual evaluation of the fog and image quality:

| | |
|---|---|
| I | 20° C., 65% RH |
| II | 30° C., 80% RH |

EXAMPLE 34

A mixture of 7 g of Resin A-7, 33 g of the following resin (R-3), 200 g of zinc oxide, 0.018 g of a cyanine dye (II) having the following structure, 0.20 g of maleic anhydride and 300 g of toluene was dispersed in a ball mill for 3 hours to prepare a light-sensitive layer-forming composition, which was then applied to a paper rendered electrically conductive to give a dry coverage of 25 g/m$^2$ by means of a wire bar coater, followed by drying at 110° C. for 30 seconds. The thus coated paper was allowed to stand in a dark place at 20° C. and 65% RH for 24 hours to prepare an electrophotographic light-sensitive material.

Resin R-3

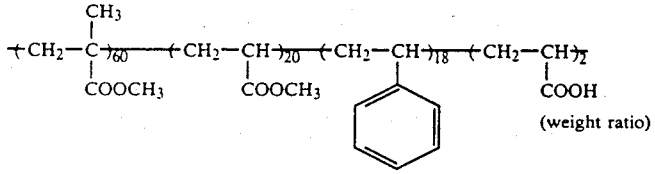

(weight ratio)

$\overline{M}w$ 6.5 × 10$^4$

Cyanine Dye II

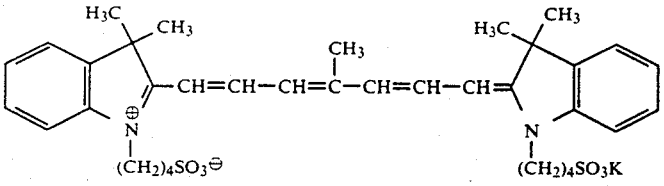

The light-sensitive material was then subjected to evaluation of the surface smoothness, electrostatic characteristics, image quality and printing property in an analogous manner to Example 33 to thus obtain the following results:

| | |
|---|---|
| Smoothness of Photoconductive Layer | 130 (sec/cc) |
| Electrostatic Characteristics | $V_{10}$: −560 (V)<br>D.R.R.: 85%<br>$E_{1/10}$: 45 (erg/cm$^2$) |
| Image Quality | I (20° C., 65%): good<br>II (30° C., 80%): good |
| Contact Angle with Water | 10° or less |
| Printing Durability | 9000 prints |

As described above, the light-sensitive material of the present invention exhibited excellent electrostatic characteristics and printing property.

EXAMPLE 35 AND COMPARATIVE EXAMPLE B

The procedures of Example 1 and Comparative Example A were repeated except using Resin B-1 consisting of a copolymer of benzyl methacrylate/2-hydroxyethyl methacrylate/acrylic acid (89/10/1 weight ratio), having an ($\overline{M}w$) of 4.3×10$^4$, instead of Resin R-1 used in Example 1 and Comparative Example A, thus obtaining the similar results thereto.

EXAMPLES 36 TO 42

The procedures of Examples 2 to 8 were repeated except using Resin B-1 instead of Resin R-1 used in Examples 2 to 8, thus obtaining the similar results.

EXAMPLE 43

A mixture of 25 g (as solid content) of Resin A- 6 of the present invention, 15 g of a resin B-2 having the following structure, 200 g of zinc oxide, 0.02 g of uranine, 0.04 g of Rose Bengal, 0.03 g of tetrabromphenol blue, 0.20 g of maleic anhydride and 300 g of toluene was ball milled for 2 hours. Then, 5 g of allyl methacrylate and 0.2 g of A.I.B.N. were added to the resulting dispersion and further ball milled for 10 minutes to prepare a light-sensitive layer-forming composition. The thus resulting light-sensitive layer-forming composition was applied to a paper rendered electrically conductive to give a dry coverage of 22 g/m$^2$ by a wire bar coater, followed by heating at 105° C. for 2 hours. The thus coated paper was allowed to stand in a dark place at 20° C. and 65% RH for 24 hours to prepare an electrophotographic light-sensitive material.

Resin B-2

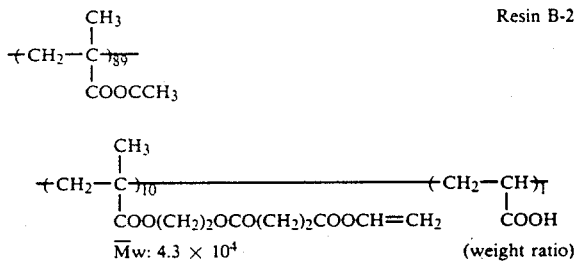

When the resulting light-sensitive material was subjected to plate making by means of the same apparatus as that of Example 1, the resulting master plate had a density of at least 1.0 and clear image.

The plate was immersed in a processing solution (E-2) consisting of an aqueous solution of 60 g of thiomalic acid, 80 g of methyl ethyl ketone and 15 g of Alkanol B (—commercial name—, manufactured by Du Pont Co.) per 1000 ml and having a pH of 9.5 at a temperature of 25° C. for 1 minute and then immersed and etched for 10 seconds in a solution obtained by diluting ELP-E (—commercial name—, manufactured by Fuji Photo Film Co., Ltd.) by 2 times with distilled water. The resulting plate was rendered sufficiently hydrophilic as represented by a contact angle with water of 10° or less.

When this plate was subjected to printing using the same printing machine as that of Example 1, 10000 or more prints of clear image were obtained without occurrence of fog on non-image areas. When the light-sensitive material was further subjected to the same processings as described above, except after allowing to stand under conditions of 45° C. and 75% RH for 3 weeks, no change appeared in the results.

EXAMPLES 44 TO 49

Example 43 was repeated except using copolymers A-28 to A-33 shown in Table 8 instead of Resin A-6 of the present invention, thus obtaining electrophotographic light-sensitive materials, each having an ($\overline{M}$w) in the range of $4\times10^4$ to $6\times10^4$.

TABLE 8

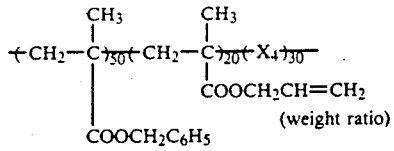

| Example | Resin of Present Invention | Copolymeric Component: Chemical structure of $X_4$ |
|---|---|---|
| 44 | [A-28] | $\leftarrow CH_2-CH\rightarrow$ <br> $COO(CH_2)_4OCOCH_2CH_2Br$ |
| 45 | [A-29] | $\leftarrow CH_2-CH\rightarrow$ <br> $OCOCH_2CH_2Br$ |
| 46 | [A-30] | $\leftarrow CH_2-CH\rightarrow$ <br> $SO_2CH_2CH_2Cl$ |
| 47 | [A-31] | $CH_3$ <br> $\leftarrow CH_2-C\rightarrow$ <br> $COO-C_6H_4-SO_2CH_2CH_2Br$ |
| 48 | [A-32] | $\leftarrow CH_2-CH\rightarrow$ <br> $COCH_2CH_2F$ |
| 49 | [A-33] | $\leftarrow CH_2-CH\rightarrow$ <br> $C_6H_4-OCOCH_2CH_2Cl$ |

These light-sensitive materials were subjected to plate making, etching and printing in an analogous manner to Example 43. The resulting master plate for offset printing had a concentration of 1.0 or more and clear image quality, and after etching, showed a contact angle with water of less than 10°.

In printing, prints showed clear image quality without fog even after printing 10000 prints.

EXAMPLES 50 TO 55

A mixture of 30 g of Resin A (as solid content) shown in Table 9, 10 g of Resin B shown in Table 9, 200 g of zinc oxide, 0.02 g of uranine, 0.05 g of Rose Bengal, 0.03 g of tetrabromphenol blue, 0.15 g of phthalic anhydride and 300 g of toluene was dispersed in a ball mill for 2 hours. To this dispersion was added a crosslinking compound as shown in the following Table 9 in a predetermined quantity and the mixture was ball milled for 10 minutes to prepare a light-sensitive layer-forming composition, which was then applied to a paper rendered electrically conductive to give a dry coverage of 25 g/m$^2$ by a wire bar coater, followed by drying at 100° C. for 30 seconds and further at 120° C. for 1 hour. The thus coated paper was allowed to stand in a dark place at 20° C. and 65% RH for 24 hours to prepare an electrophotographic light-sensitive material.

TABLE 9

| Example | Resin A | Resin B (weight ratio) | Crosslinking Compound | Quantity |
|---|---|---|---|---|
| 50 | [A-8] | [B-3] 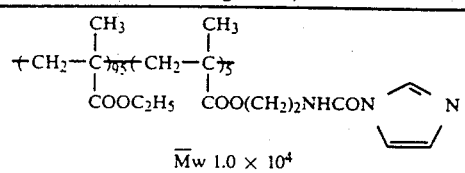 $\overline{M}w$ 1.0 × $10^4$ | 1,6-hexadiamine | 1.2 g |
| 51 | [A-9] | [B-4] 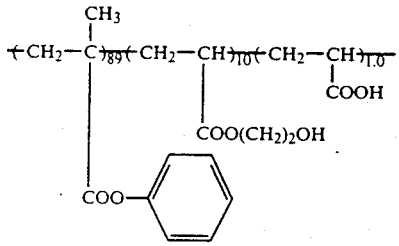 $\overline{M}w$ 3.8 × $10^4$ | 1,3-xylylene diisocyanate | 1.6 g |
| 52 | [A-10] | [B-5] 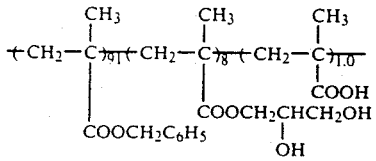 $\overline{M}w$ 3.5 × $10^4$ | 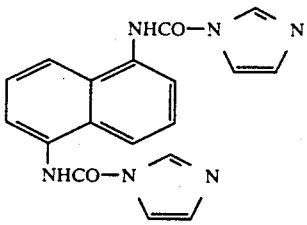 | 2.0 g |
| 53 | [A-11] | [B-6] 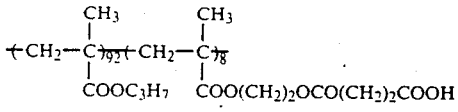 $\overline{M}w$ 8.5 × $10^3$ | ethylene glycol diglycidyl ether | 4 g |
| 54 | [A-12] | [B-7] 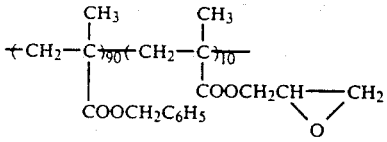 $\overline{M}w$ 4.5 × $10^4$ | pyromellitic anhydride | 8 g |
| 55 | [A-13] | [B-8] 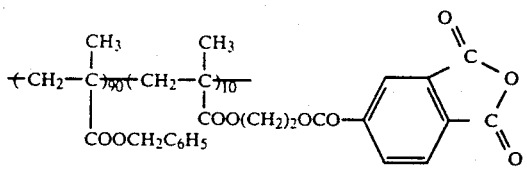 $\overline{M}w$ 3.0 × $10^4$ | no | |

Each of the light-sensitive materials of the present invention exhibited excellent electrostatic characteristics, dark decay retention and photosensitivity and gave a clear reproduced image that is free from occurrence of background stains and disappearance of fine lines even under severer conditions, e.g., high temperature and high humidity (30° C., 80% RH).

When the plate making was carried out in an analogous manner to Example 1, the resulting master plate for offset printing had a density of at least 1.0 and clear image quality. When it was subjected to an etching treatment and printing by a printing machine, 10000 or more prints with a clear image were obtained without occurrence of fog on non-image areas.

EXAMPLES 56 TO 61

A mixture of 7 g of Resin A-17, 20 g of a resin of Group X in Resin B shown in the following Table 10, 200 g of zinc oxide, 0.50 g of Rose Bengal, 0.25 g of tetrabromphenol blue, 0.30 g of uranine, 0.01 g of phthalic anhydride and 240 g of toluene was dispersed in a ball mill for 2 hours.

To this dispersion was added a solution of 13 g of a resin of Group Y in Resin B shown in Table 10 dissolved in 80 g of toluene and further dispersed in a ball mill for 10 minutes. The resulting dispersion was applied to a paper rendered electrically conductive to give a dry coverage of 18 g/m$^2$ by a wire bar coater, followed by heating at 110° C. for 30 seconds and further at 120° C. for 2 hours. The thus coated paper was allowed to stand in a dark place at 20° C. and 65% RH for 24 hours to prepare an electrophotographic light-sensitive material.

Resin R-4

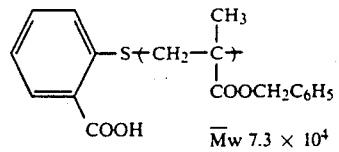

$\overline{M}w$ 7.3 × 10$^4$

The light-sensitive material was then subjected to

TABLE 10

| Sample | Resin B Group X | Resin B Group Y |
|---|---|---|
| 56 | 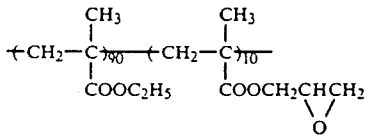 [B-9] $\overline{M}w$ 42,000 | 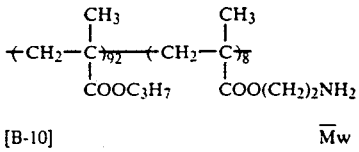 [B-10] $\overline{M}w$ 38,000 |
| 57 | 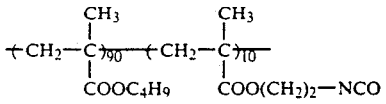 [B-11] $\overline{M}w$ 45,000 | [B-10] |
| 58 | 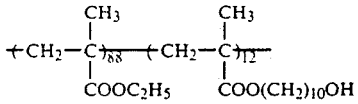 [B-12] $\overline{M}w$ 38,000 | 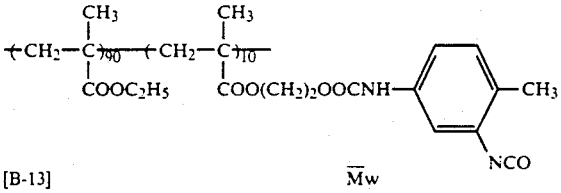 [B-13] $\overline{M}w$ 46,000 |
| 59 | [B-10] | 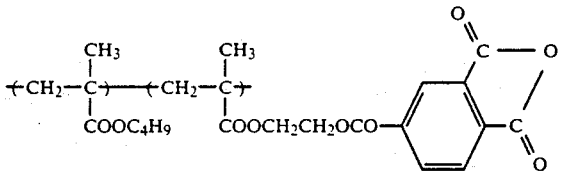 [B-14] $\overline{M}w$ 33,000 |
| 60 | [B-12] | [B-14] |
| 61 | [B-10] | [B-13] |

EXAMPLE 62

A mixture of 23.5 g of Resin A-5, 10 g of Resin B-1, 6.5 g of a resin (R-4) represented by the following structure, 200 g of zinc oxide, 0.02 g of Cyanine Dye II, 0.20 g of phthalic anhydride and 300 g of toluene was dispersed in a ball mill for 3 hours, to which 2 g of 1,3-xylylene diisocyanate was added, followed by further dispersing in a ball mill for 10 minutes. The resulting dispersion was coated onto a paper rendered electrically conductive to give a dry coverage of 22 g/m$^2$ by a wire bar coated, followed by heating at 100° C. for 15 second and further at 120° C. for 2 hours. The thus coated paper was allowed to stand in a dark place at 20° C. and 65% RH for 24 hours to prepare an electrophotographic light-sensitive material.

evaluation of the film property (surface smoothness), electrostatic characteristics and reproduced image quality, in particular, under ambient conditions of 30° C. and 80% RH. Furthermore, when using the light-sensitive material as a master plate for offset printing, the oil-desensitivity of the photoconductive layer in terms of a contact angle of the photoconductive layer with water after oil-desensitization and the printing performance in terms of a stain resistance and printing durability were evaluated.

| Smoothness of Photoconductive Layer | 120 (cc/sec) | | |
|---|---|---|---|
| | Electrostatic Characteristics[8)] | | |
| | V (V) | D.R.R. (%) | $E_{1/10}$ (erg/cm$^2$) |
| I (20° C., 65%) | −550 | 88 | 33 |
| II (30° C., 80%) | −540 | 85 | 30 |
| Image Quality[9)] | Good reproduced images were obtained under any conditions of (20° C., 65% RH) | | |

-continued

| | |
|---|---|
| | and (30° C., 80% RH). |
| Printing Durability | 10,000 good prints were obtained. |

As described above, the light-sensitive material of the present invention exhibited excellent electrostatic characteristics and printing property. The electrostatic characteristics and image quality were measured by the following procedures:

8) Electrostatic Characteristics

The light-sensitive material was subjected to corona discharge at −6 kV for 20 seconds in a dark room at a temperature of 20° C. and relative humidity of 65% using a paper analyzer (Paper Analyzer SP-428 —commercial name— manufactured by Kawaguchi Denki KK) and then allowed to stand for 10 seconds, at which the surface potential $V_{10}$ was measured. Then, the sample was further allowed to stand in the dark room as it was for 90 seconds to measure the surface potential $V_{100}$, thus obtaining the retention of potential after the dark decay for 90 seconds, i.e., dark decay retention ratio (DRR (%)) represented by $(V_{100}/V_{10})\times 100(\%)$. Moreover, the surface of the photoconductive layer was negatively charged to −400 V by corona discharge, then irradiated with a gallium-aluminum-arsenic semiconductor laser beam (oscillation wavelength: 830 nm) and the rime required for decay of the surface potential ($V_{10}$) to 1/10 was measured to evaluate an exposure quantity $E_{1/10}$ (erg/cm$^2$). The ambient conditions for the measurement of the electrostatic characteristics were:

| | |
|---|---|
| I | 20° C., 65% RH |
| II | 30° C., 80% RH |

9) Image Quality

The light-sensitive material was allowed to stand for a whole day and night under the following ambient conditions, charged at −6 KV, imagewise exposed rapidly at a pitch of 25 μm and a scanning speed of 300 m/sec under irradiation of 64 erg/cm$^2$ on the surface of the light-sensitive material using a gallium-aluminum-arsenic semiconductor laser (oscillation wavelength: 780 nm) with an output of 2.8 mW as a light source, developed with a liquid developer, ELP-T (—commercial name—, manufactured by Fuji Photo Film Co., Ltd.) and fixed to obtain a reproduced image which was then subjected to visual evaluation of the fog and image quality:

| | |
|---|---|
| I | 20° C., 65% RH |
| II | 30° C., 80% RH |

As described above, the light-sensitive material of the present invention gave excellent electrophotographic properties and high printing durability.

EXAMPLES 63 TO 74

Using each of the light-sensitive materials prepared in the foregoing Examples, master plates for offset printing were prepared by carrying out the etching treatment as in the following.

0.5 mole of each of nucleophilic compounds shown in Table 11, 100 g of each of organic solvents shown in Table 11 and 10 g of Newcol B 4 SN (—commercial name—, manufactured by Nippon Nyukazai KK) were added to distilled water to 1000 ml, the pH being adjusted to 10.0 to prepare a processing solution. Each of the light-sensitive materials was immersed and etched in a solution prepared by diluting by 2 times ELP-E with distilled water for 20 seconds and then immersed in the above described processing solution at 25° C. for 1 minute.

The thus resulting plate was subjected to printing under the same printing conditions as in Example 1.

TABLE 11

| Example | Light-sensitive Material | Nucleophilic Compound | Organic Solvent |
|---|---|---|---|
| 63 | Example 36 | sodium sulfite | benzyl alcohol |
| 64 | Example 37 | monoethanolamine | " |
| 65 | Example 38 | diethanolamine | methyl ethyl ketone |
| 66 | Example 39 | thiomalic acid | ethylene glycol |
| 67 | Example 40 | thiosalicylic acid | benzyl alcohol |
| 68 | Example 41 | taurine | isopropyl alcohol |
| 69 | Example 42 | 4-sulfobenzene-sulfinic acid | benzyl alcohol |
| 70 | Example 43 | thioglycolic acid | ethanol |
| 71 | Example 46 | 2-mercaptoethyl-phosphonic acid | dioxane |
| 72 | Example 50 | potassium sulfite | — |
| 73 | Example 62 | sodium thio-sulfate | methylethyl ketone |
| 74 | Example 52 | 2-mercaptoethane-sulfonic acid | benzyl alcohol |

In printing, prints showed clear image quality without fog even after printing 10000 prints.

EXAMPLES 75 TO 76

Example 62 was repeated except using 10 g of Resin B shown in Table 12 instead of 10 g of Resin B-1 and not using 1,3-xylylene diisocyanate to prepare a light-sensitive material.

Each of the resulting light-sensitive materials was irradiated by a high voltage mercury lamp of 400 W for 3 minutes at a distance of 30 cm and allowed to stand in a dark place under conditions of 20° C. and 65% RH for 24 hours to prepare a master plate for lithographic printing.

TABLE 12

| Example | Resin B | Copolymer Composition (weight ratio) |
|---|---|---|
| 75 | [B-15] | 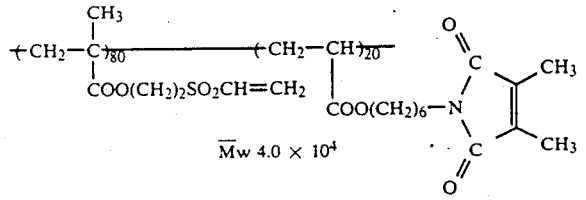 $\overline{M}w$ 4.0 × $10^4$ |
| 76 | [B-16] | 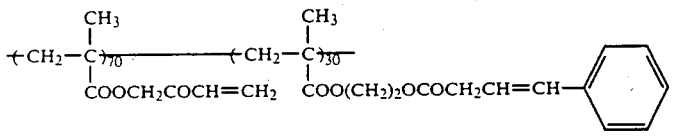 $\overline{M}w$ 6.5 × $10^4$ |

When the plate making was carried out in an analogous manner to Example 1, the resulting master plate for offset printing had a density of at least 1.2 and clear image quality. When it was subjected to an etching treatment and printing by a printing machine, 10000 or more prints with a clear image were obtained without occurrence of fog on non-image areas.

As illustrated above, according to the present invention, there is provided an electrophotographic lithographic printing plate precursor, in which the effect by the hydrophilic property of non-image areas is further improved, and which is stable during storage even under very severe conditions and capable of readily realizing the hydrophilic property in a short time during processing for rendering hydrophilic.

What is claimed is:

1. An electrophotographic lithographic printing plate precursor comprising a conductive support having provided thereon at least one photoconductive layer containing photoconductive zinc oxide and a binder resin, wherein said binder resin comprises at least one resin containing at least one polymeric component having at least one of functional groups represented by the following General Formula (I) and General Formula (II):

General Formula (I)

$$-W_1\text{-}(CH_2)_{n1}\text{-}CH{=}CH_2$$

General Formula (II)

$$-W_2\text{-}(CH_2)_{n2}\text{-}CH_2CH_2\text{-}X$$

wherein $-W_1-$ and $-W_2-$ each represent $-SO_2-$, $-CO-$ or $-OOC-$, $n_1$ and $n_2$ each represent 0 or 1 and X represents a halogen atom.

2. The electrophotographic lithographic printing plate precursor as claimed in claim 1, wherein the resin containing at least one polymeric component having a functional group represented by General Formula (I) and/or General Formula (II) is previously crosslinked.

3. The electrophotographic lithographic printing plate precursor as claimed in claim 1, wherein the resin containing at least one polymeric component having a functional group represented by General Formula (I) and/or General Formula (II) further contains at least one functional group causing a hardening reaction by heat and/or light.

4. The electrophotographic lithographic printing plate precursor as claimed in claim 1, wherein the polymeric component having the functional group represented by General Formula (I) and/or General Formula (II) is in a proportion of 1 to 90% by weight to the binder resin consisting of a copolymer.

5. The electrophotographic lithographic printing plate precursor as claimed in claim 1, wherein the polymeric component contains a crosslinking functional group in a copolymeric component containing the functional group represented by General Formula (I) and/or General Formula (II) or in another copolymeric component therefrom.

6. The electrophotographic lithographic printing plate precursor as claimed in claim 5, wherein the copolymeric component containing a crosslinking functional group is in a proportion of 1 to 80% by weight to the binder resin.

7. The electrophotographic lithographic printing plate precursor as claimed in claim 1, wherein the binder resin is in a proportion of 10 to 100 parts by weight to 100 parts by weight of the photoconductive zinc oxide.

8. The electrophotographic lithographic printing plate precursor as claimed in claim 1, wherein the photoconductive layer further contains at least one dye as a spectral sensitizer.

9. An electrophotographic lithographic printing plate precursor comprising a conductive support having provided thereon at least one photoconductive layer containing photoconductive zinc oxide and a binder resin, wherein said binder resin comprises at least one resin A, at least one resin B and optionally a crosslinking agent:

Resin A resin containing at least one polymeric component having at least one of functional groups represented by the following General Formula (I) General Formula (II):

General Formula (I)

$$-W_1\text{-}(CH_2)_{n1}\text{-}CH{=}CH_2$$

General Formula (II)

$$-W_2\text{-}(CH_2)_{n2}\text{-}CH_2CH_2\text{-}X$$

wherein $-W_1-$ and $-W_2-$ each represent $-SO_2-$, $-CO-$ or $-OOC-$, $n_1$ and $n_2$ each represent 0 or 1 and X represents a halogen atom, and Resin B heat- and/or light-hardenable resin.

10. The electrophotographic lithographic printing plate precursor as claimed in claim 9, wherein the heat- and/or light-hardenable resin contains a copolymeric component having a heat- and/or light-hardenable functional group.

11. The electrophotographic lithographic printing plate precursor as claimed in claim 9, wherein Resin B consists of a(meth)acrylic copolymer.

12. The electrophotographic lithographic printing plate precursor as claimed in claim 9, wherein Resin B contains a copolymeric component containing a cross-linking (hardenable) functional group in a proportion of 0.5 to 40 mole % to Resin B.

13. The electrophotographic lithographic printing plate precursor as claimed in claim 9, wherein Resin A contains a copolymeric component containing a heat and/or light hardenable functional group in a proportion of 1 to 20% by weight of Resin A.

14. The electrophotographic lithographic printing plate precursor as claimed in claim 9, wherein Resin A and Resin B are mixed with a Resin A to Resin B ratio of 5-80 to 95-20 by weight.

15. The electrophotographic lithographic printing plate precursor as claimed in claim 1 or claim 9, wherein when processed with a processing solution containing at least one nucleophilic hydrophilic compound, the hydrophilic compound is added to the end of the functional group to render the binder resin hydrophilic.

16. The electrophotographic lithographic printing plate precursor as claimed in claim 1 or claim 9, wherein the polymeric component having the functional group represented by General Formula (I) and/or General Formula (II) is represented by the following repeating unit of General Formula (III):

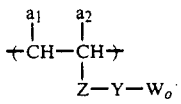

General Formula (III)

wherein Z represent —COO—, —OCO—, —O—, —CO—,

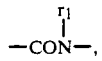

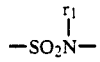

wherein $R_1$ represents hydrogen atom or a hydrocarbon group, —CONHCOO—, —CONHCONH—, —$CH_2$COO—, —$CH_2$OCO— or

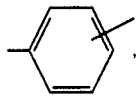

Y represents a direct bond or organic radical for connecting —Z— and —$W_0$, ⟨Z-Y) can directly connect

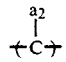

and —$W_0$, $W_0$ represents the functional group represented by General Formula (I) or (II) and $a_1$ and $a_2$ may be same or different, each being hydrogen atom, a halogen atom, cyano group, an alkyl group or an aryl group.

17. The electrophotographic lithographic printing plate precursor as claimed in claim 1 or claim 2, wherein the resin containing at least one polymeric component having a functional group represented by General Formula (I) and/or (II) has a molecular weight of $10^3$ to $10^6$.

18. The electrophotographic lithographic printing plate precursor as claimed in claim 1 or claim 2, wherein the binder resin further contains a crosslinking agent.

* * * * *